US008923729B2

(12) United States Patent
Itabashi

(10) Patent No.: US 8,923,729 B2
(45) Date of Patent: Dec. 30, 2014

(54) IMAGE-FORMING DEVICE HAVING DRAWER TO WHICH CARTRIDGES ARE DETACHABLY ATTACHABLE

(71) Applicant: Nao Itabashi, Nagoya (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/076,803

(22) Filed: Nov. 11, 2013

(65) Prior Publication Data

US 2014/0072334 A1 Mar. 13, 2014

Related U.S. Application Data

(63) Continuation of application No. 13/075,064, filed on Mar. 29, 2011, now Pat. No. 8,588,648.

(30) Foreign Application Priority Data

May 17, 2010 (JP) ..... 2010-113664

(51) Int. Cl.
*G03G 21/18* (2006.01)
*G03G 21/16* (2006.01)
*G03G 15/08* (2006.01)

(52) U.S. Cl.
CPC ..... *G03G 21/1661* (2013.01); *G03G 15/0886* (2013.01); *G03G 21/1623* (2013.01); *G03G 2215/0692* (2013.01); *G03G 2221/1684* (2013.01)
USPC ..... 399/114; 399/110; 399/120; 399/258

(58) Field of Classification Search
CPC ..... G03G 21/1623; G03G 21/1661; G03G 15/0886; G03G 2215/0692; G03G 2221/1684
USPC ..... 399/109–111, 113, 114, 119, 120, 399/258–259, 262, 263; 222/DIG. 1
See application file for complete search history.

(56) References Cited

U.S. PATENT DOCUMENTS

2002/0141787 A1* 10/2002 Hattori et al. ..... 399/257
2006/0067734 A1 3/2006 Igarashi (Continued)

FOREIGN PATENT DOCUMENTS

CN 1755555 A 4/2006
CN 101057186 A 10/2007

(Continued)

OTHER PUBLICATIONS

Japan Patent Office, Decision to Grant for Japanese Patent Application No. 2010-113664 (counterpart to above-captioned patent application), mailed Apr. 3, 2012.

(Continued)

*Primary Examiner* — Walter L Lindsay, Jr.
*Assistant Examiner* — Jessica L Eley
(74) *Attorney, Agent, or Firm* — Baker Botts L.L.P.

(57) ABSTRACT

In an image forming device, a drawer moves between an accommodated position in which the drawer is accommodated in an accommodation space of a main casing of the image forming device and a pull-out position in which at least part of the drawer is outside the accommodation space. Cartridges are detachably attachable to the drawer. A moving member is provided at the drawer, and moves between a first position and a second position. A stop member provided in the main casing prevents the drawer from moving to the accommodated position when the drawer is on its way to the accommodated position from the pull-out position while the moving member is at the first position, and permits the drawer to move to the accommodated position when the drawer is on its way to the accommodated position from the pull-out position while the moving member is at the second position.

10 Claims, 24 Drawing Sheets

(56) References Cited

U.S. PATENT DOCUMENTS

| | | | | |
|---|---|---|---|---|
| 2008/0260422 | A1* | 10/2008 | Sasae et al. | 399/119 |
| 2009/0142079 | A1 | 6/2009 | Sato et al. | |
| 2009/0169267 | A1 | 7/2009 | Sakuma | |
| 2009/0180802 | A1 | 7/2009 | Sato et al. | |
| 2009/0190955 | A1* | 7/2009 | Igarashi et al. | 399/113 |
| 2010/0021201 | A1 | 1/2010 | Tamaru | |
| 2010/0067947 | A1 | 3/2010 | Yuzawa | |
| 2010/0080615 | A1 | 4/2010 | Kikuchi | |
| 2011/0033201 | A1 | 2/2011 | Akutsu et al. | |
| 2011/0217068 | A1 | 9/2011 | Kamimura et al. | |
| 2012/0057905 | A1* | 3/2012 | Itabashi | 399/258 |
| 2013/0084101 | A1 | 4/2013 | Igarashi et al. | |

FOREIGN PATENT DOCUMENTS

| | | | |
|---|---|---|---|
| CN | 101059682 | A | 10/2007 |
| JP | H03-002777 | A | 1/1991 |
| JP | H08-248754 | A | 9/1996 |
| JP | H09-106159 | A | 4/1997 |
| JP | H09-269639 | A | 10/1997 |
| JP | H09-269716 | A | 10/1997 |
| JP | 2006098772 | A | 4/2006 |
| JP | 2008-032755 | A | 2/2008 |
| JP | 2009-086289 | A | 4/2009 |
| JP | 2009-139489 | A | 6/2009 |
| JP | 2009-157204 | A | 7/2009 |
| JP | 2009-163274 | A | 7/2009 |
| JP | 2010-032573 | A | 2/2010 |
| JP | 2010-072307 | A | 4/2010 |
| JP | 2010-102304 | A | 5/2010 |
| JP | 2011-053656 | A | 3/2011 |
| JP | 2011-186067 | A | 9/2011 |

OTHER PUBLICATIONS

State Intellectual Property Office of the People's Republic of China, The First Office Action for Chinese Patent Application No. 201110141319.2 (counterpart Chinese patent application), mailed Oct. 9, 2012.

State Intellectual Property Office of the People's Republic of China, The Second Office Action for Chinese Patent Application No. 201110141319.2 (counterpart to above-captioned patent application), mailed Jun. 5, 2013.

* cited by examiner

IMAGE-FORMING DEVICE HAVING DRAWER TO WHICH CARTRIDGES ARE DETACHABLY ATTACHABLE

CROSS REFERENCE TO RELATED APPLICATION

This application is a continuation of U.S. patent application Ser. No. 13/075,064, filed on Mar. 29, 2011, which claims priority from Japanese Patent Application No. 2010-113664, filed May 17, 2010. The contents of the above noted applications are incorporated herein by reference in their entirety.

TECHNICAL FIELD

The present invention relates to an image forming device such as a laser printer.

BACKGROUND

According to a conventional tandem type color printer, four photosensitive drums for the colors of yellow magenta, cyan and black can be integrally attached to or detached from a main casing.

In such type of color printer, a frame can be pulled out in a horizontal direction from the main casing, and four photosensitive drums are held in the frame and arrayed in a pull-out direction of the frame. Further, developing cartridges provided with developing rollers and corresponding to these photosensitive drums are detachably mounted on the frame from the above. If toner in a developing cartridge gets empty, the developing cartridge is taken out of the frame, and a new developing cartridge is mounted on the frame.

SUMMARY

Recently, a low cost and environmentally preferable printer is required. To this effect, exchange in toner box only is preferable rather than exchange in developer cartridge when the toner is used up. In the exchange in toner box only, only the toner box is exchanged with a new toner box while a developing roller remains in the frame.

It is an object of the invention to provide an improved image-forming device, in which a holder unit is movably provided and a toner box is detachably mounted in the holder unit.

In order to attain the above and other objects, the invention provides an image forming device including: a main casing; a drawer; a plurality of cartridges; a moving member; and a stop member. The main casing defines an accommodation space. The drawer is configured to move in a moving direction between an accommodated position in which the drawer is accommodated in the accommodation space and a pull-out position in which at least part of the drawer is outside the accommodation space. The plurality of cartridges are detachably attachable to the drawer. The moving member is configured to move between a first position and a second position. The moving member is provided at the drawer. The stop member is provided in the main casing. The stop member is configured to: prevent the drawer from moving to the accommodated position when the drawer is on its way to the accommodated position from the pull-out position while the moving member is at the first position, and permit the drawer to move to the accommodated position when the drawer is on its way to the accommodated position from the pull-out position while the moving member is at the second position.

DETAILED DESCRIPTION

Next, an embodiment of the present invention will be described while referring to the accompanying drawings.

1. Structure of a Color Printer

Figure 1:
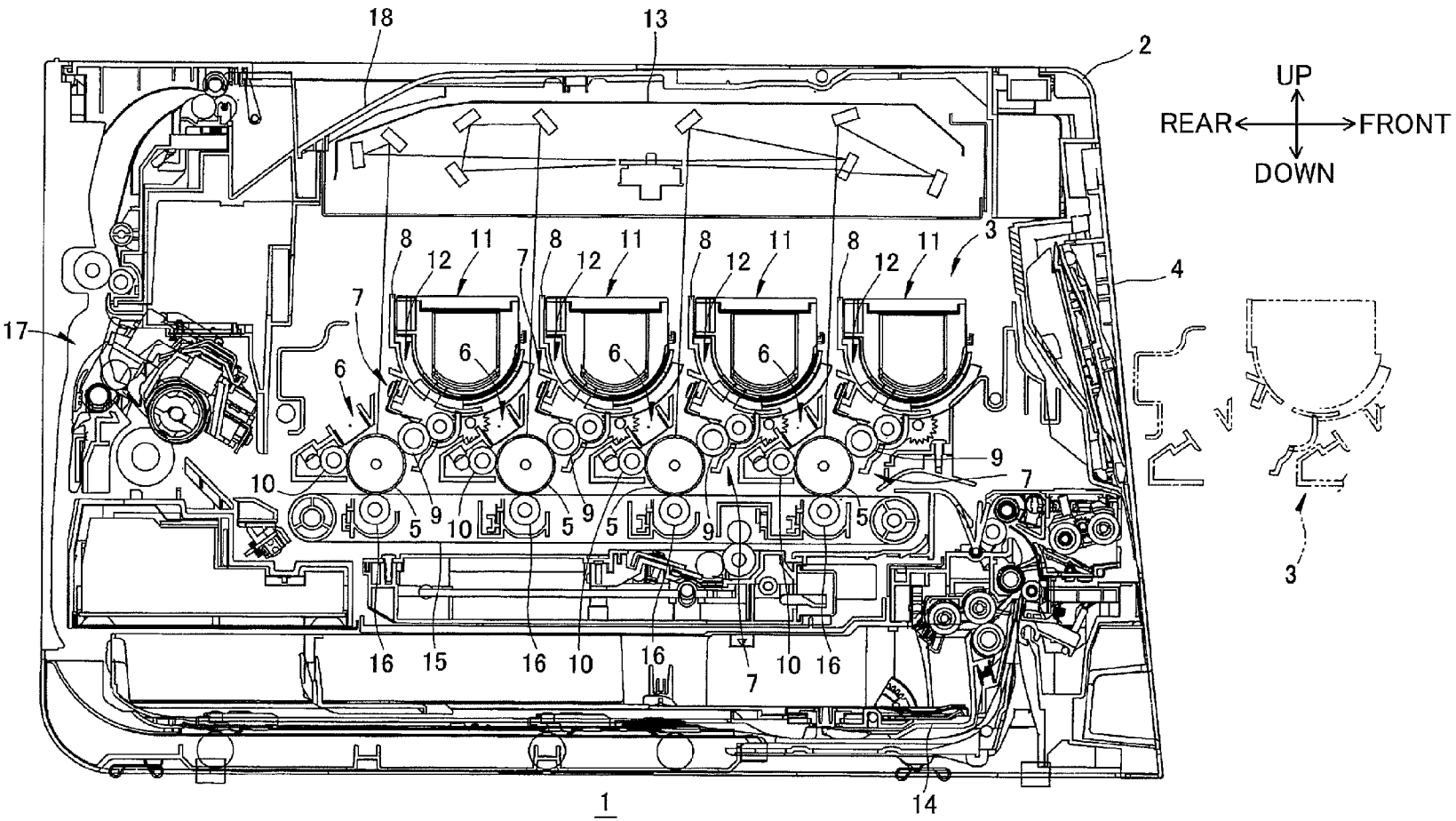
FIG. 1 is a cross-sectional view of a color printer according to an embodiment of the present invention.
Figure 2:
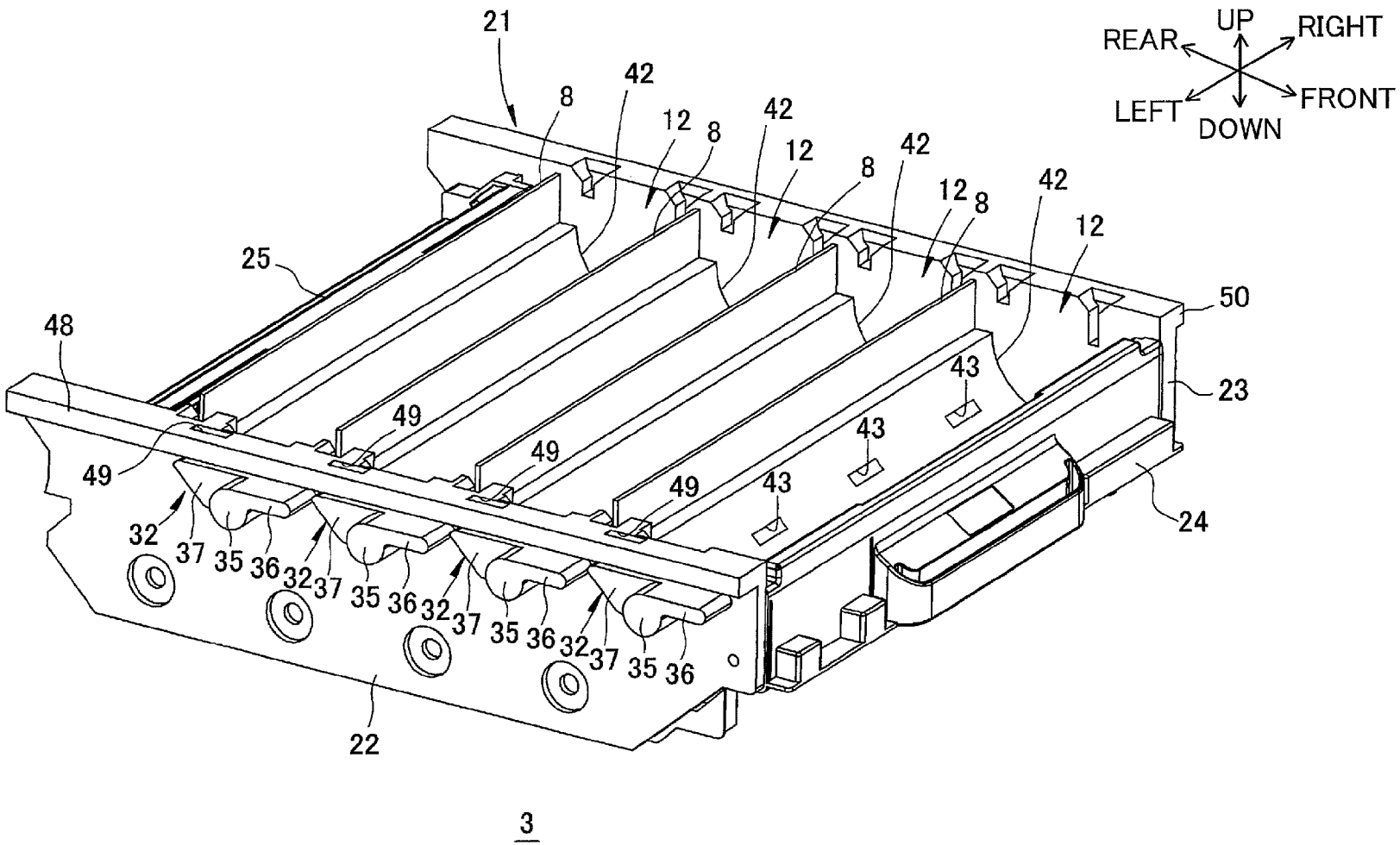
FIG. 2 is a perspective view of a drawer unit shown in FIG. 1, from which all toner boxes are removed, operation members being in a second position.

As shown in FIG. 1, the image-forming device according to the embodiment is a tandem-type color printer 1. As shown in FIGS. 1 and 2, the color printer 1 includes a main casing 2. A drawer unit 3 is mounted inside the main casing 2. A front cover 4 is provided on the front surface of the main casing 2 and is capable of being opened and closed thereon. When the front cover 4 is open, the drawer unit 3 can be moved horizontally between an accommodated position inside the main casing 2, as indicated by solid lines in FIG. 1, and a pull-out position outside the main casing 2, as depicted virtually by dotted lines in FIG. 1 and shown in FIG. 17A. It is noted that when the drawer unit 3 is in the pull-out position, the drawer unit 3 protrudes outside the main casing 2 through an opening of the main casing 2 opened by the front cover 4, but is still partly mounted in the main casing 2. That is, when the drawer unit 3 is in the pull-out position, the drawer unit 3 is not detached from the main casing 2, but is still supported by the main casing 2.

In the following description, the side of the color printer 1 on which the front cover 4 is provided (right side in FIG. 1) will be referred to as the front side of the color printer 1. The top, bottom, left, and right sides of the color printer 1 in the following description will be based on the reference point of a user viewing the color printer 1 from the front side. Directions related to the drawer unit 3 and toner boxes 11, described later, that are mounted in the drawer unit 3 will be referenced based on their positions when mounted in the main casing 2, unless otherwise specified.

As shown in FIG. 1, four photosensitive drums 5 (image-bearing members) are rotatably retained in the drawer unit 3. The photosensitive drums 5 are capable of rotating about axes extending in the left-to-right direction. The four photosensitive drums 5 are respectively provided for the colors black, yellow, magenta, and cyan. The photosensitive drums 5 are arranged parallel to each other at regular intervals in the front-to-rear direction in the order black, yellow, magenta, and cyan.

Four chargers 6 are also retained in the drawer unit 3. The chargers 6 have a one-on-one correspondence to the four photosensitive drums 5 and are disposed at positions diagonally upward and rearward from the corresponding photosensitive drums 5. Each charger 6 is a Scorotron charger that includes a discharge wire and grid, for example.

Four developing units 7 are also retained in the drawer unit 3. The four developing units 7 also have a one-on-one correspondence to the four photosensitive drums 5 and are disposed diagonally above and forward of the corresponding photosensitive drums 5. Each developing unit 7 includes a developing unit frame 8, and a developing roller 9 accommodated in the developing unit frame 8. The developing roller 9 is disposed in contact with the photosensitive drum 5 and is capable of rotating about an axis extending in the left-to-right direction.

Four cleaners 10 are also retained in the drawer unit 3. The cleaners 10 are provided with a one-on-one correspondence to the four photosensitive drums 5 and are positioned rearward of the corresponding photosensitive drums 5. The cleaners 10 function to move paper dust and the like deposited on the surfaces of the photosensitive drums 5.

A space 12 is provided in the drawer unit 3 above each developing unit 7. A toner box 11 that accommodates toner is mounted in the space 12 formed above each developing unit 7. Sufficient room above the drawer unit 3 for mounting the toner boxes 11 in the spaces 12 is acquired by pulling the drawer unit 3 outward to the pull-out position. The toner boxes 11 supply toner to the corresponding developing units 7.

An exposure device 13 is provided in the main casing 2 above the drawer unit 3. The exposure device 13 irradiates four laser beams corresponding to the four colors used by the color printer 1.

As each photosensitive drum 5 rotates, the corresponding charger 6 applies a uniform charge to the surface of the photosensitive drum 5 through corona discharge. Subsequently, the exposure device 13 irradiates laser beams for selectively exposing the surfaces of the photosensitive drums 5. This exposure selectively removes charge from the surfaces of the photosensitive drums 5, forming electrostatic latent images thereon. When the electrostatic latent image carried on the surface of a photosensitive drum 5 rotates to a position opposite the corresponding developing roller 9, the developing roller 9 supplies toner to the latent image, developing the image into a toner image. That is, the developing roller 9 executes a developing operation.

Here, four LED arrays may be provided for the four photosensitive drums 5 in place of the exposure device 13.

A paper cassette 14 accommodating sheets of a paper P is disposed in a bottom section of the main casing 2. The paper P accommodated in the paper cassette 14 is conveyed onto a conveying belt 15 by various rollers. The conveying belt 15 confronts the four photosensitive drums 5 from below. Four transfer rollers 16 are disposed inside the conveying belt 15 at positions confronting each of the photosensitive drums 5 through the upper portion of the conveying belt 15. When a sheet of paper P is conveyed onto the conveying belt 15, the conveying belt 15 carries the sheet sequentially through positions between the conveying belt 15 and each of the photosensitive drums 5. As the sheet passes beneath each photosensitive drum 5, the toner image carried on the surface of the photosensitive drum 5 is transferred onto the paper P.

A fixing unit 17 is provided on the downstream end of the conveying belt 15 with respect to the direction that the paper P is conveyed. After toner images are transferred onto a sheet of paper P, the sheet is conveyed to the fixing unit 17, where the toner images are fixed to the sheet by heat and pressure. After the toner images are fixed in the fixing unit 17, various rollers discharge the sheet onto a discharge tray 18 formed on the top surface of the main casing 2.

2. Drawer Unit (1) Drawer Frame

Figure 3:
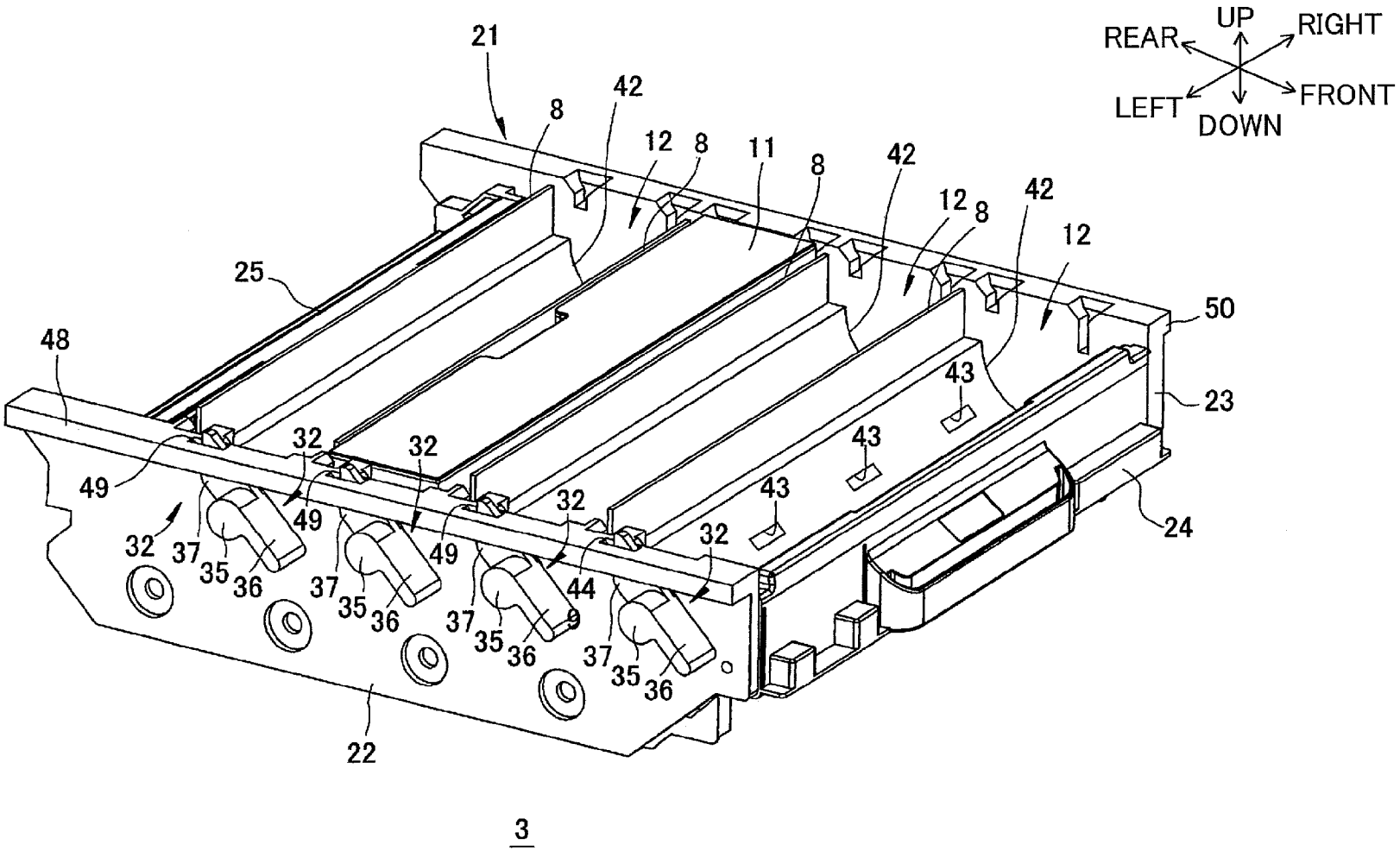
FIG. 3 is a perspective view of the drawer unit, from which three toner boxes are removed, and in which one toner box is retained, the operation members being in a first position.

As shown in FIGS. 2 and 3, the drawer unit 3 has a drawer frame 21 (holder unit). The drawer frame 21 is configured of a pair of side plates 22 and 23 arranged parallel to each other and separated in the left-to-right direction, a front beam 24 bridging the front ends of the side plates 22 and 23, and a rear beam 25 bridging the rear ends of the side plates 22 and 23. The overall structure of the drawer frame 21 is square-shaped in a plan view.

The respective groups of four photosensitive drums 5, chargers 6, developing units 7, and cleaners 10 (see FIG. 1) are all held together between the side plates 22 and 23 on the left and right sides thereof. The spaces 12 in which the toner boxes 11 are mounted are formed between the side plates 22 and 23 above the corresponding developing units 7. In other words, the side plates 22 and 23 hold the photosensitive drums 5, chargers 6, developing units 7, and cleaners 10. Further, the side plates 22 and 23 oppose each other in the left-to-right direction, with gaps formed therebetween to allocate the spaces 12 in which the toner boxes 11 are mounted.

(2) Operation Member

Four operation members 32 are provided at a left side (outer side) of the left side plate 22 at positions corresponding to the four spaces 12, respectively. Each operation member 32 includes a fulcrum portion 35 having a circular shape as viewed from a left side, an elongated plate like extension portion 36 extending from the fulcrum portion 35, and an interference portion 37 positioned opposite to the extension portion 36 with respect to the fulcrum portion 35. The fulcrum portion 35, extension portion 36 and interference portion 37 are integrally formed.

The fulcrum portion 35 has a center portion fixed to a coupling shaft (not shown), which is rotatably supported by the left side plate 22 and which extends through the left side plate 22. Thus, the fulcrum portion 35 is pivotally movable about an axis of the coupling shaft.

The interference portion 37 has a triangular shape as viewed from the left side and is tapered in a direction away from the fulcrum portion 35.

Figure 4A:
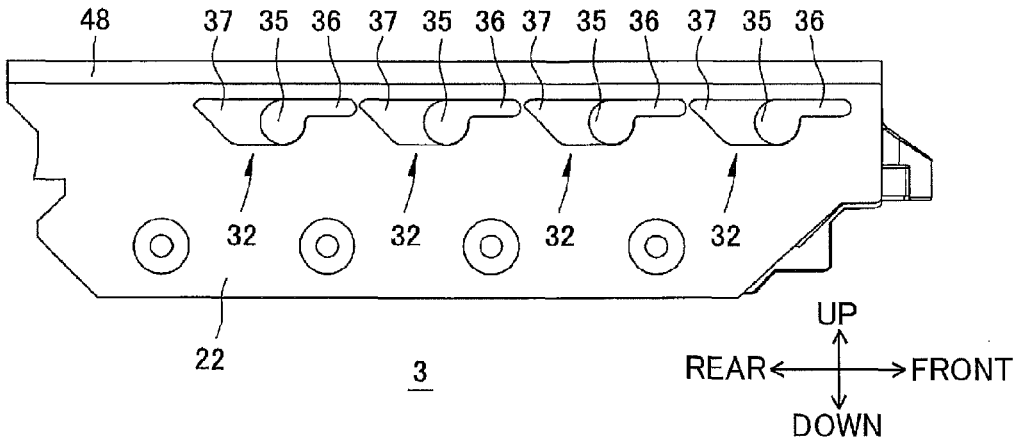
FIG. 4A is a left side view of the drawer unit when the operation members are in the second position.
Figure 4B:
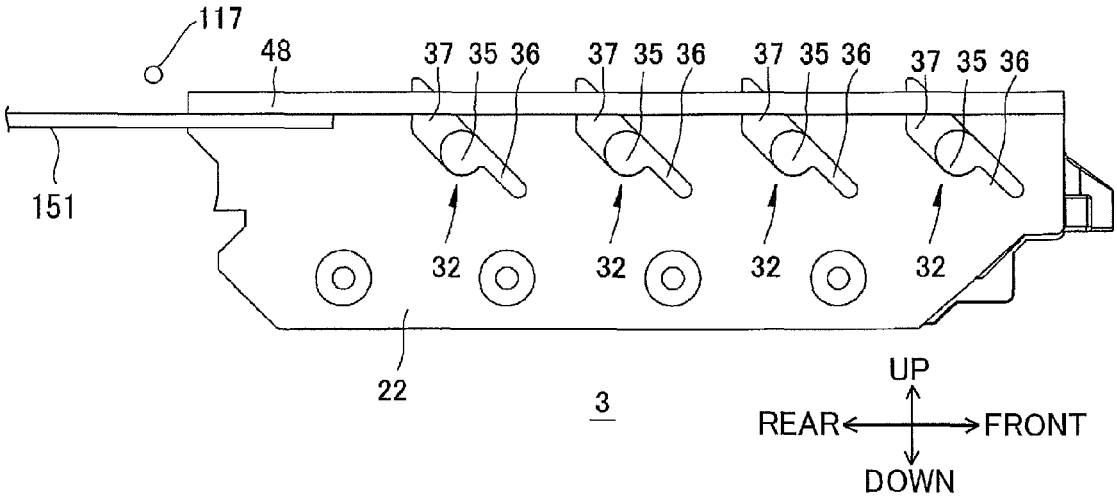
FIG. 4B is a left side view of the drawer unit when the operation members are in the first position, and shows a positional relationship between the drawer unit and a stop member provided in the main casing.

The operation member 32 is pivotally movable about the center of the fulcrum portion 35 to selectively provide a first position shown in FIGS. 3 and 4B where the extension portion 36 is inclined frontward and downward, and a second position shown in FIGS. 2 and 4A where the extension portion 36 is oriented horizontally frontward.

The left side plate 22 has an upper end portion provided with a flange portion 48 bending leftward. The flange portion 48 is formed with through-holes 49 at such positions that oppose the interference portions 37. Apex portions of the interference portions 37 can pass through the through-holes 49.

As shown in FIGS. 2 and 4A, each interference portion 37 extends rearward and horizontally and each apex portion of the interference portion 37 is positioned below the flange portion 48 when the operation member 32 is at the second position. On the other hand, as shown in FIGS. 3 and 4B, each interference portion 37 extends rearward and upward so that each apex portion protrudes above the flange portion 48 through the through-hole 49 when the operation member 32 is at the first position.

Further, the right side plate 23 has an upper end portion provided with a flange portion 50 bent rightward.

(3) Power Transmission Mechanism

Figure 5:
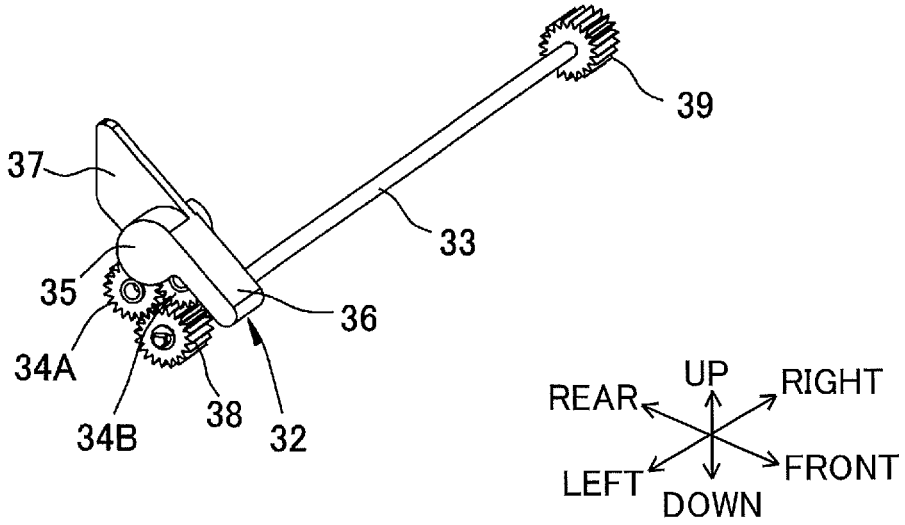
FIG. 5 is a perspective view of a power transmission mechanism for the operation member.
Figure 6:
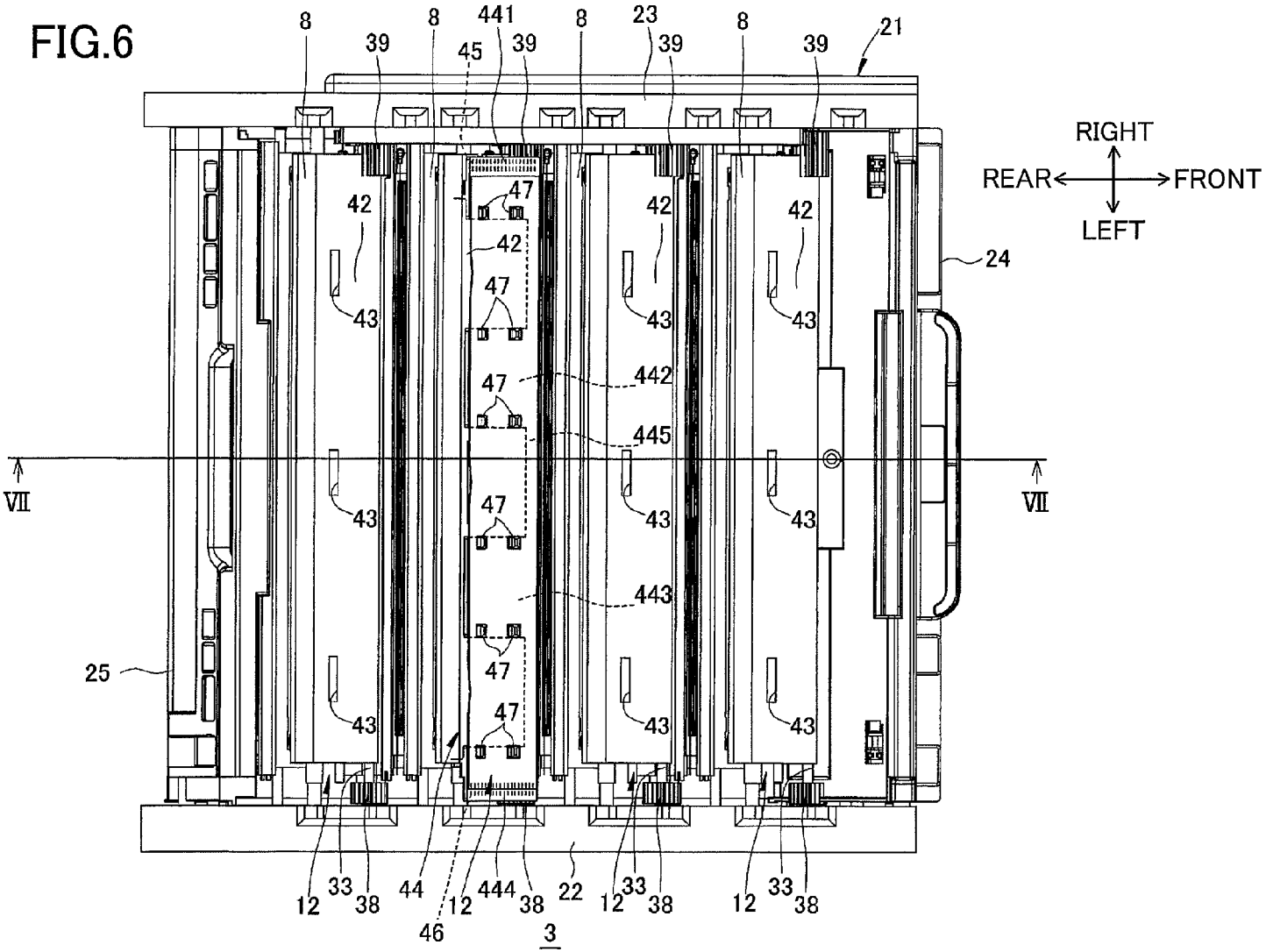
FIG. 6 is a plan view of the drawer unit in FIG. 2.

As shown in FIGS. 5 and 6, a shaft 33 extending in the lateral direction is positioned below each operation member 32. The shaft 33 spans between the left side plate 22 and right side plate 23 and is rotatably supported thereto. The shaft 33 has a left end portion fixedly provided with a left pinion gear 38 at a position laterally inward of (right side of) the left side plate 22. A minute gap is provided between a leftmost end of the left pinion gear 38 and the left side plate 22 so as not to disturb the rotation of the left pinion gear 38. The shaft 33 has a right end portion fixedly provided with a right pinion gear 39 at a position laterally inward of (left side of) the right side plate 23. The right pinion gear 39 has an axial length greater than that of the left pinion gear 38. A minute gap is provided between a rightmost end of the right pinion gear 39 and the right side plate 23 so as not to disturb the rotation of the right pinion gear 39.

A gear wheel (not shown) is positioned opposite to the fulcrum portion 35 with respect to the left side plate 22. The gear wheel is fixed to a right end portion of the coupling shaft (not shown) that rotatably extends through the left side plate 22 and that is fixed to the fulcrum portion 35. Thus, the gear wheel is integrally rotatable along with the coupling shaft and the fulcrum portion 35. That is, the gear wheel is coaxially and integrally provided with the fulcrum portion 35. Two intermediary gears 34A, 34B are provided for driving connection between the gear wheel and the left pinion gear 38.

(4) Developing Unit Frame

As shown in FIGS. 2 and 6, the developing unit frames 8 are disposed at regular intervals in the front-to-rear direction and span between the side plates 22 and 23. The developing unit frames 8 define the spaces 12 provided for mounting the toner boxes 11.

Figure 7:
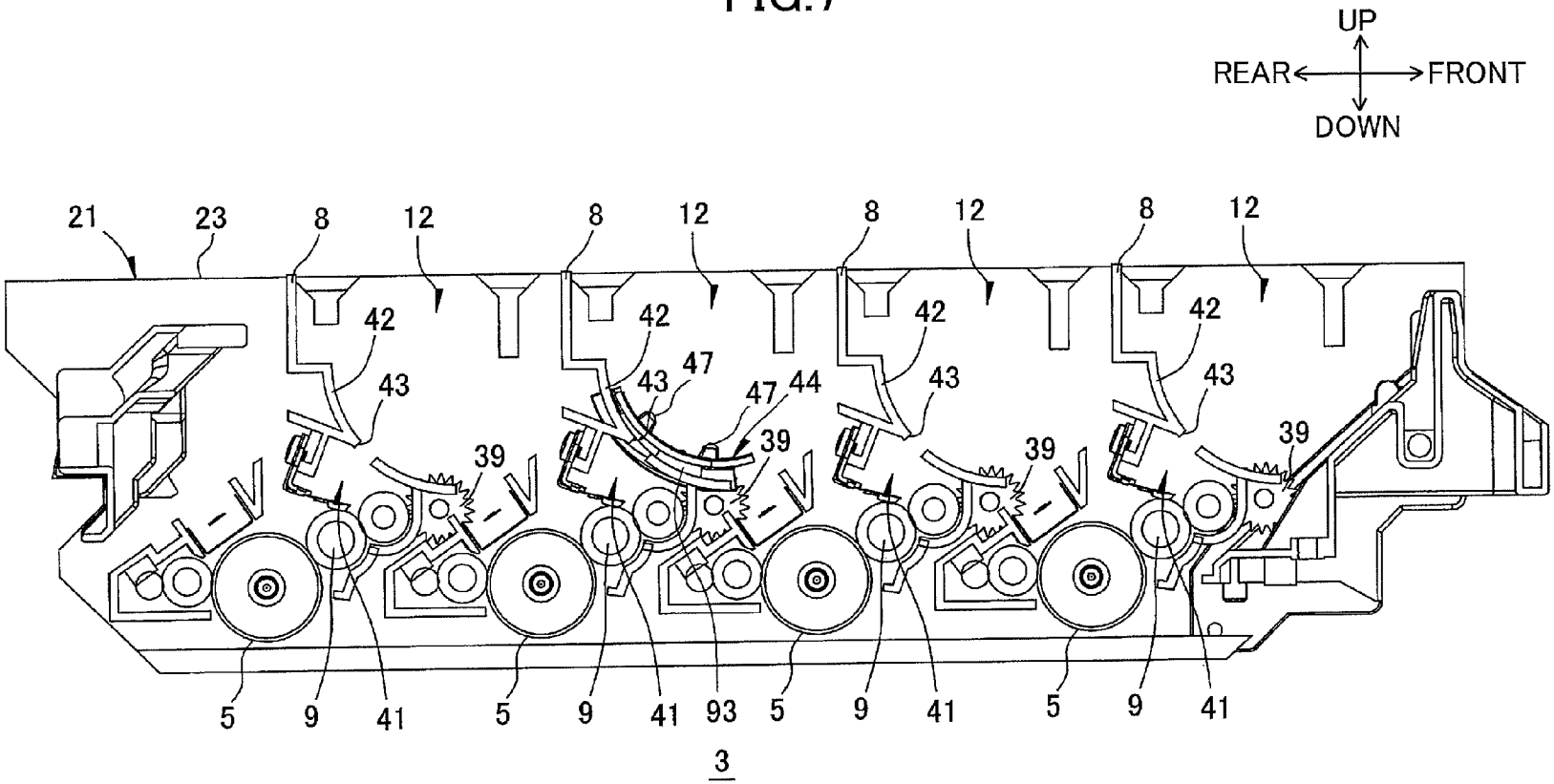
FIG. 7 is a cross-sectional view of the drawer unit taken along the cross-sectional line VII-VII shown in FIG. 6.

As shown in FIG. 7, a developing chamber 41 is formed in each developing unit frame 8 for accommodating the developing roller 9. The side of the developing chamber 41 opposing the corresponding photosensitive drum 5 is open. The developing roller 9 is disposed in the bottom of the developing chamber 41 near the open side thereof.

The developing unit frame 8 also has a plate-shaped partitioning wall 42 positioned between the developing chamber 41 and the space 12. The partitioning wall 42 curves in an arc shape with its convex side facing the developing chamber 41. The partitioning wall 42 partitions the interior of the developing unit frame 8 into the developing chamber 41 and the space 12 formed above the developing chamber 41. As shown in FIG. 2, three rectangular openings 43 are formed in the circumferential center of the partitioning wall 42. The rectangular openings 43 are formed at positions opposing three main-body-side communication through-holes 58 (described later with reference to FIG. 11) formed in the toner box 11 when the toner box 11 is mounted in the space 12.

(5) Shutter Drive Member

As shown in FIGS. 6 and 7, a shutter drive member 44 is movably disposed above the partitioning wall 42 for driving a shutter 73 described later.

Figure 8:
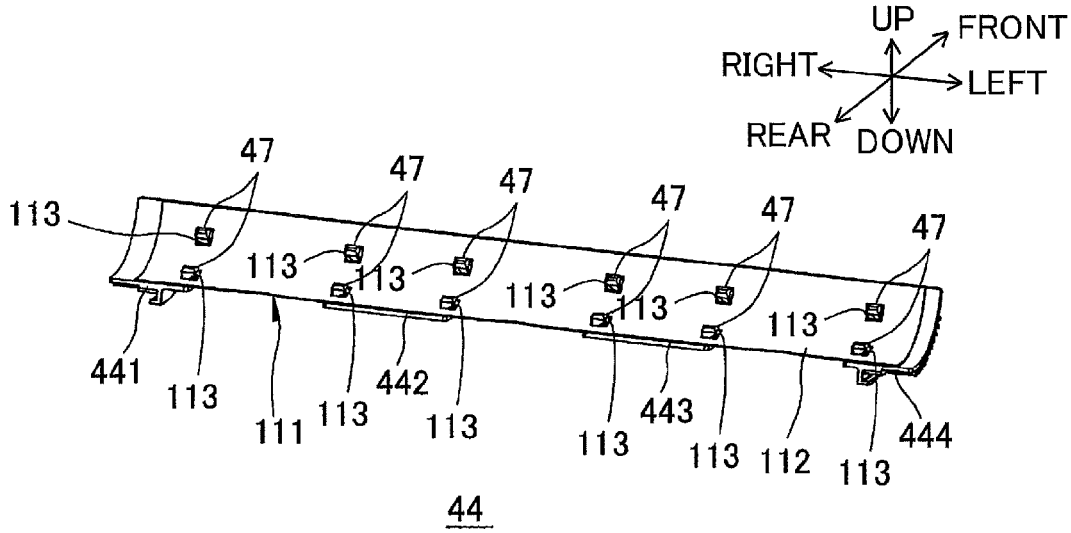
FIG. 8 is a perspective view of a shutter drive member shown in FIG. 7.

As shown in FIG. 8, the shutter drive member 44 includes a main body part 111 (resin plate) formed of a resin, and a reinforcing plate 112 (metal plate) formed of a thin metal plate that is affixed to the main body part 111.

Figure 9:
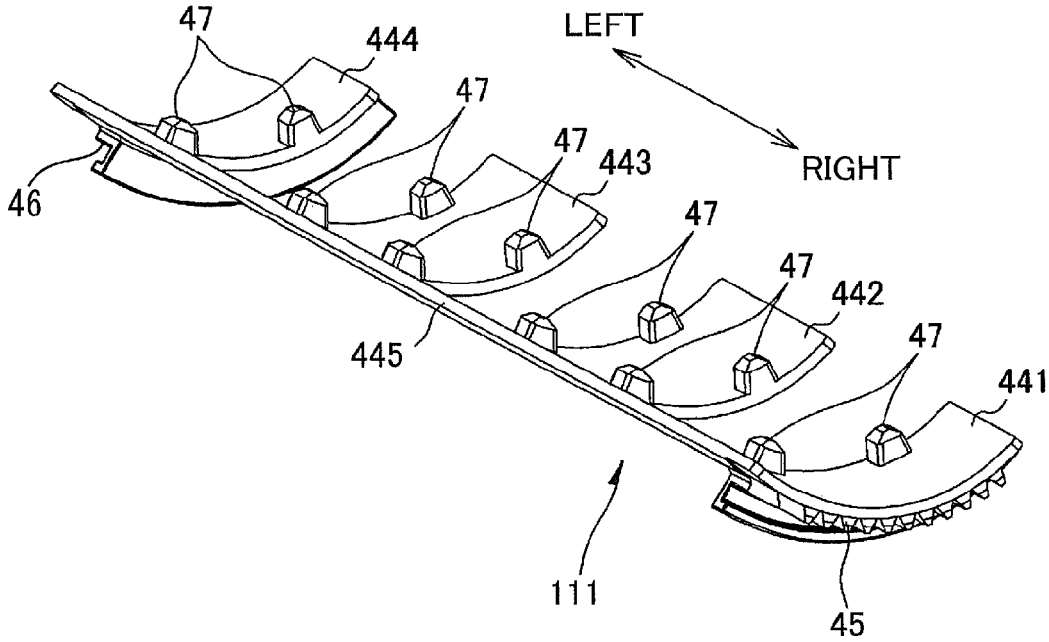
FIG. 9 is a perspective view of a main body part of the shutter drive member shown in FIG. 8.

As shown in FIG. 9, the main body part 111 is integrally configured of four plate-shaped parts 441, 442, 443, and 444 arranged at intervals in the left-to-right direction; and a coupling part 445 having a bar shape that extends in the left-to-right direction for coupling the front edges of the plate-shaped parts 441-444. Each of the plate-shaped parts 441-444 is formed of a plate curved in an arc, with the convex side facing the developing chamber 41. The curved arc of the plate-shaped part substantially conforms to the shape of the partitioning wall 42.

The shutter drive member 44 is provided above the partitioning wall 42 of each developing unit frame 8. For simplification, only the shutter drive member 44 disposed above one partitioning wall 42 is shown in FIGS. 6 and 7.

As shown in FIG. 6, the plate-shaped part 444 on the left end confronts the top of the left pinion gear 38. A left rack gear 46 is formed on the bottom surface of the plate-shaped part 444 (the surface opposing the left pinion gear 38) for engaging with the left pinion gear 38.

As shown in FIG. 6, the plate-shaped part 441 on the right end confronts the top of the right pinion gear 39. A right rack gear 45 is formed on the bottom surface of the plate-shaped part 441 opposing the right pinion gear 39 and is engaged with the right pinion gear 39.

When a user operates the operation member 32 to rotate the left pinion gear 38 and right pinion gear 39, the rotations of the left pinion gear 38 and right pinion gear 39 are transferred to the left rack gear 46 and right rack gear 45, respectively. As a result, the shutter drive member 44 moves between a position opposing the rectangular openings 43 (the position shown in FIG. 7) and a position forward of the rectangular openings 43. More specifically, when one of the operation members 32 is moved from the first position (FIG. 3) to the second position (FIG. 2), the corresponding shutter drive member 44 moves forward from the position opposing the rectangular openings 43 along with the rotations of the left pinion gear 38 and right pinion gear 39 and is placed in a position not opposing the rectangular openings 43.

From this state, if the operation member 32 is moved from the second position to the first position, the shutter drive member 44 moves rearward along with the rotations of the left pinion gear 38 and right pinion gear 39 from the position not opposing the rectangular openings 43 to the position opposing the rectangular openings 43.

Shutter drive protrusions 47 are formed on the top surfaces of the plate-shaped parts 441-444 at positions corresponding to shutter drive openings 88 described later.

The reinforcing plate 112 covers the entire region of the main body part 111, excluding the right edge of the plate-shaped part 441 and the left edge of the plate-shaped part 444. Insertion through-holes 113 are formed in the reinforcing plate 112 at positions overlapping the shutter drive protrusions 47. Each of the shutter drive protrusions 47 is inserted through a corresponding insertion through-hole 113 and protrudes upward from the reinforcing plate 112.

By overlaying the reinforcing plate 112 on the main body part 111 in this way, it is possible to ensure sufficient rigidity of the shutter drive member 44 so that the shutter drive member 44 can move the shutter 73 described later with reference to FIG. 11 with sufficient stability.

Further, by inserting the shutter drive protrusions 47 through the insertion through-holes 113 in the reinforcing plate 112, the position of the reinforcing plate 112 relative to the main body part 111 remains fixed with the shutter drive protrusions 47 protruding from the reinforcing plate 112.

Since the three rectangular openings 43 formed in the partitioning wall 42 are opened and closed by the reinforcing plate 112 moving in association with the shutter drive member 44, the reinforcing plate 112 functions as a developing-device-side shutter for opening and closing the rectangular openings 43.

3. Toner Box (1) Main Body

Figure 10:
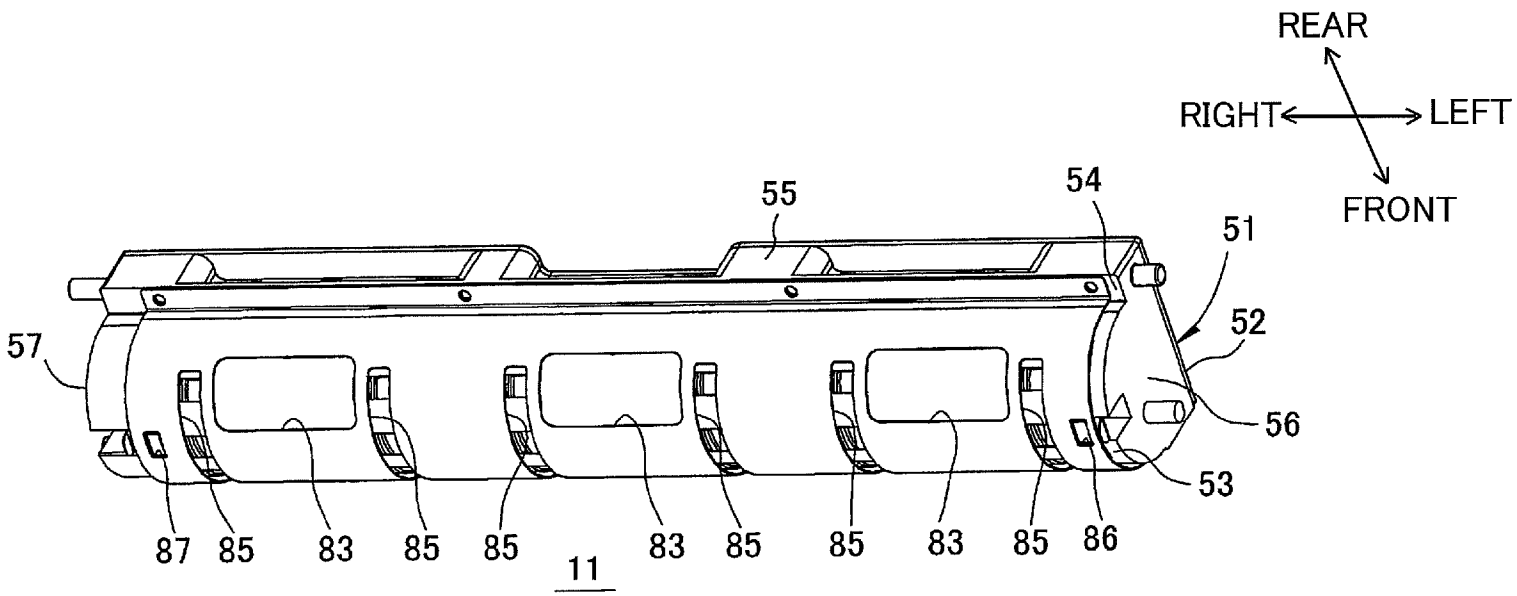
FIG. 10 is a perspective view of one of the toner boxes shown in FIG. 1.
Figure 11:
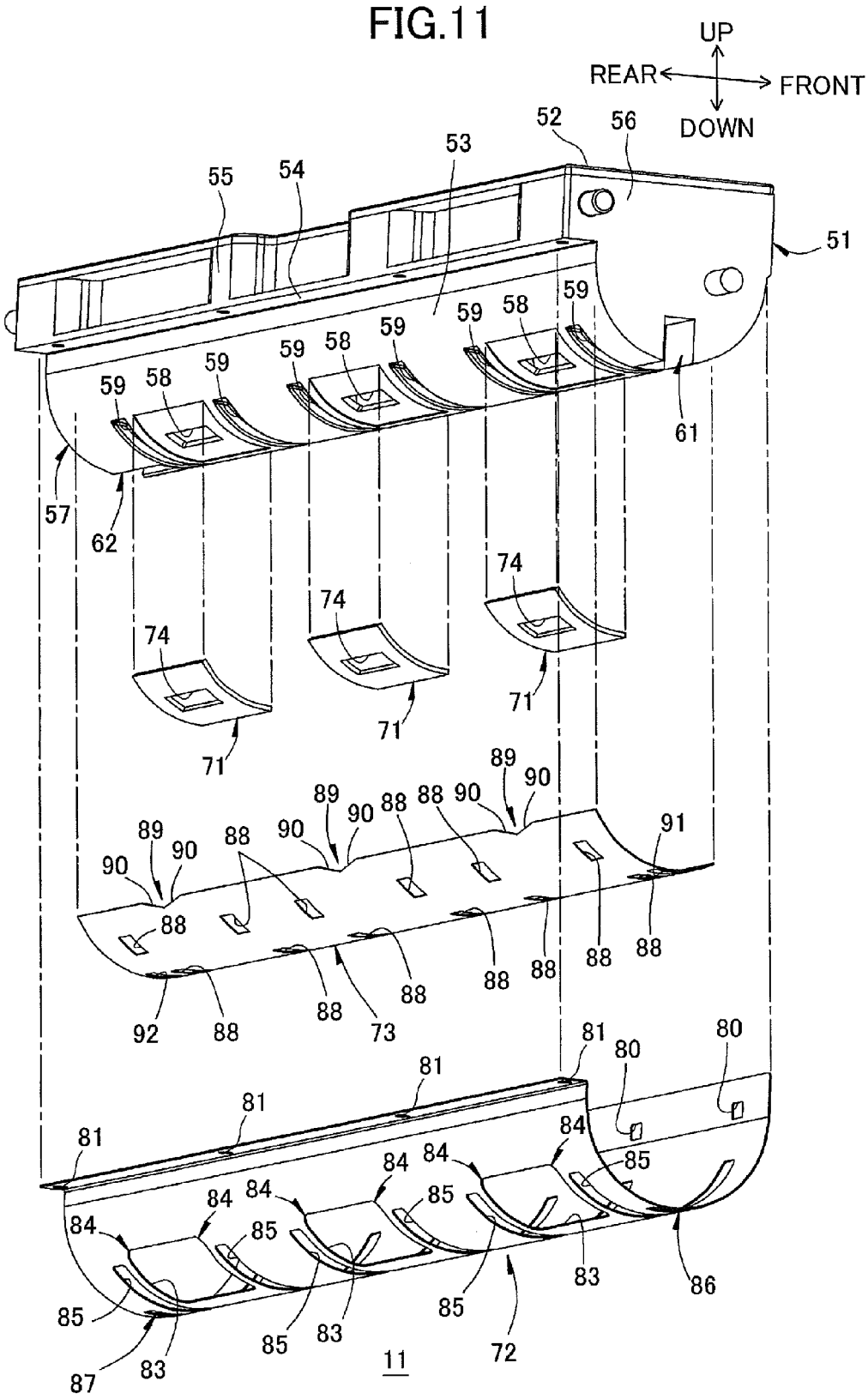
FIG. 11 is an exploded perspective view of the toner box in FIG. 10.

As shown in FIGS. 10 and 11, the toner box 11 includes a main body or toner container 51 for accommodating toner. The main body 51 is formed of a resin material in a substantially hollowed-out semicircular column shape and is elongated in the left-to-right direction. More specifically, the main body 51 has an internal space for accommodating toner that is formed by: a rectangular top surface 52 elongated in the left-to-right direction; an arcing surface 53 that is connected to the front edge of the top surface 52 and that has a substantially semicircular arc shape in a cross section with the convex side facing downward; a fixing surface 54 extending parallel to the top surface 52 and protruding rearward from the rear edge of the arcing surface 53; a rear surface 55 bridging the rear edge of the top surface 52 and the rear edge of the fixing surface 54; a left side surface 56 bridging the respective left edges of the top surface 52, arcing surface 53, fixing surface 54 and rear surface 55; and a right side surface 57 bridging the respective right edges of the top surface 52, arcing surface 53, fixing surface 54, and rear surface 55.

As shown in FIG. 11, three main-body-side communication through-holes (openings) 58 are formed in the arcing surface 53 of the main body 51 at positions slightly rearward of the lowest end thereof. The main-body-side communication through-holes 58 are rectangular in shape and elongated in the left-to-right direction and are spaced at intervals in the left-to-right direction. The main-body-side communication through-holes 58 provide communication between the interior and exterior of the main body 51.

Narrow slit-shaped relief grooves 59 are also formed in the arcing surface 53. The relief grooves 59 extend in the peripheral direction of the arcing surface 53 and are formed one on each of the left and right sides of each main-body-side communication through-hole 58.

Figure 15A:
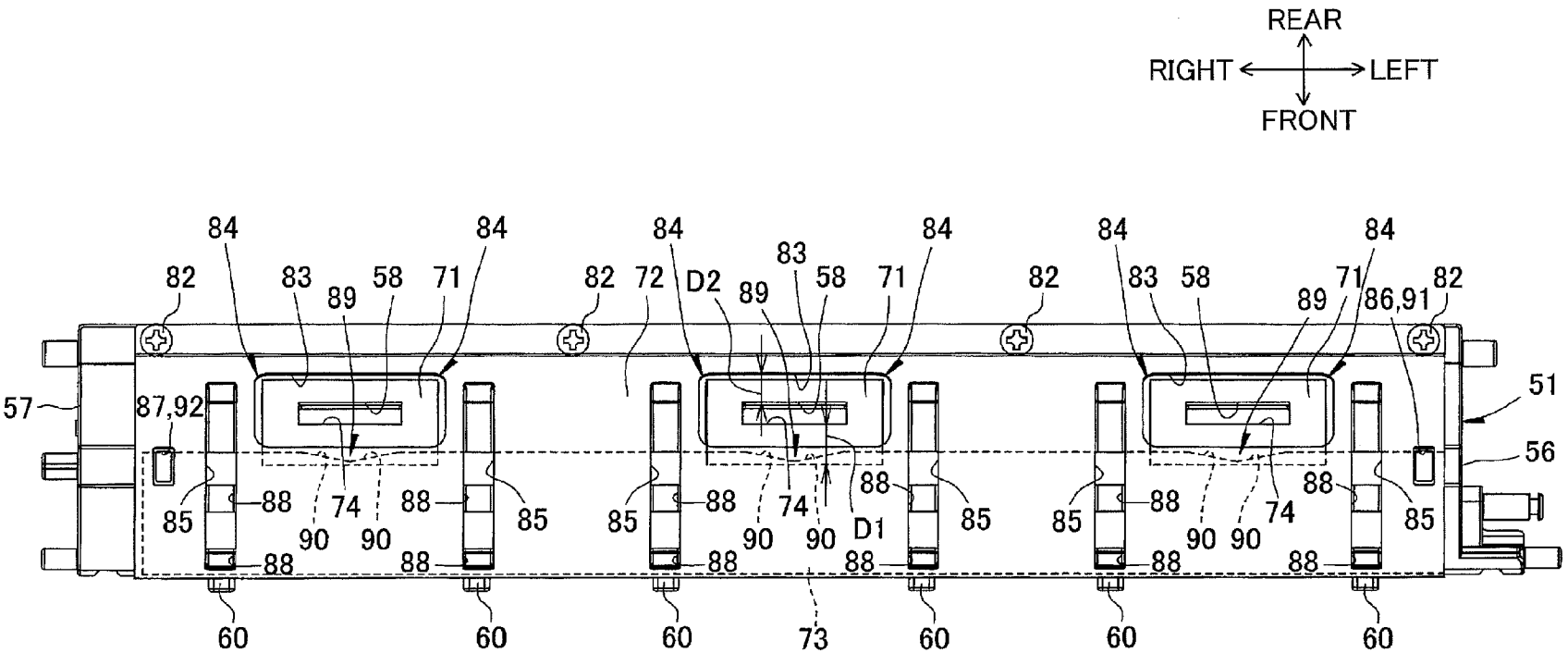
FIG. 15A is a bottom view of the toner box in FIG. 10 when the shutter is in the open position.
Figure 15B:
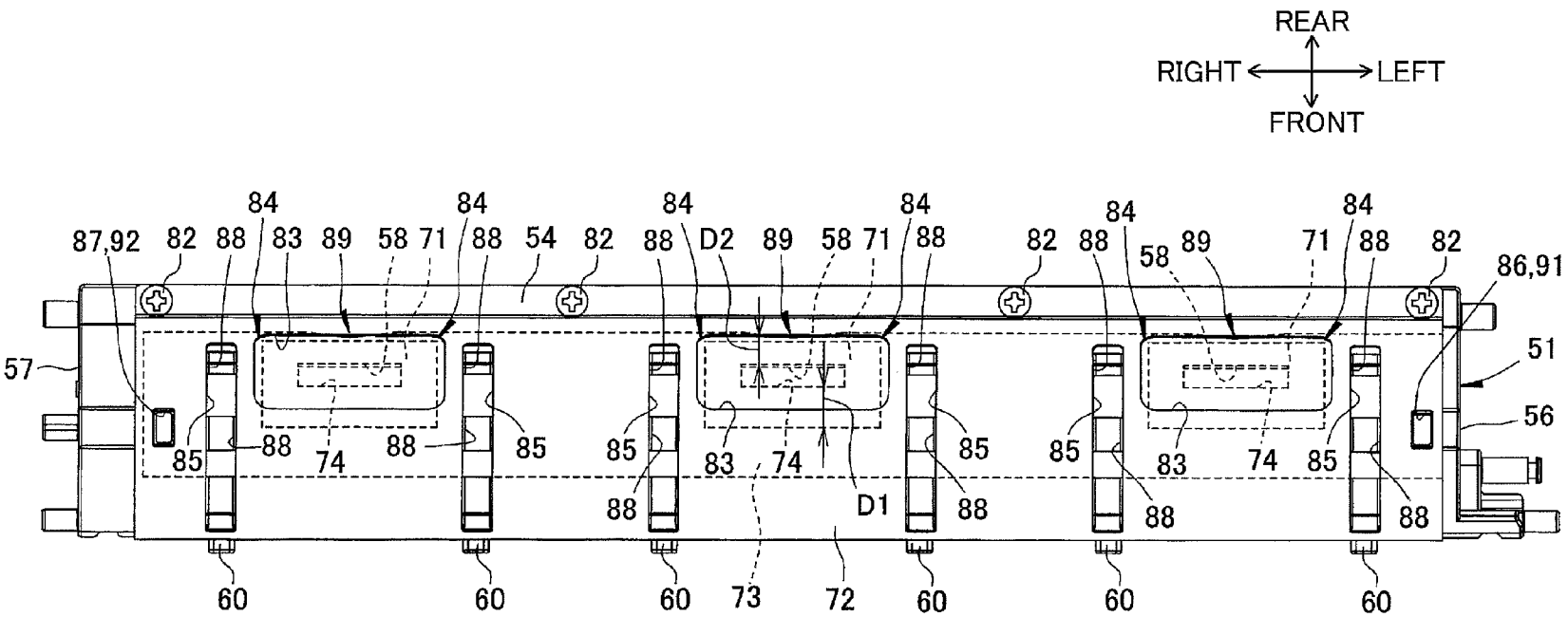
FIG. 15B is a bottom view of the toner box when the shutter is in the closed position.
Figure 16A:
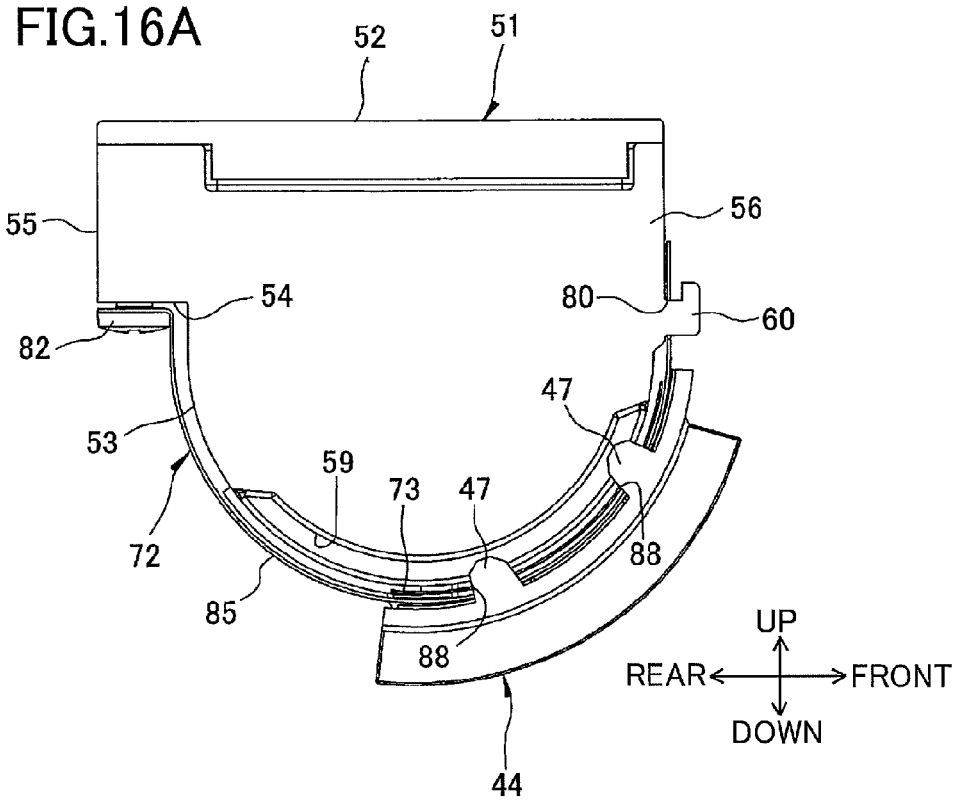
FIG. 16A is a cross-sectional view of the toner box in FIG. 10 and the shutter drive member in FIG. 7 when the shutter is in the open position.
Figure 16B:
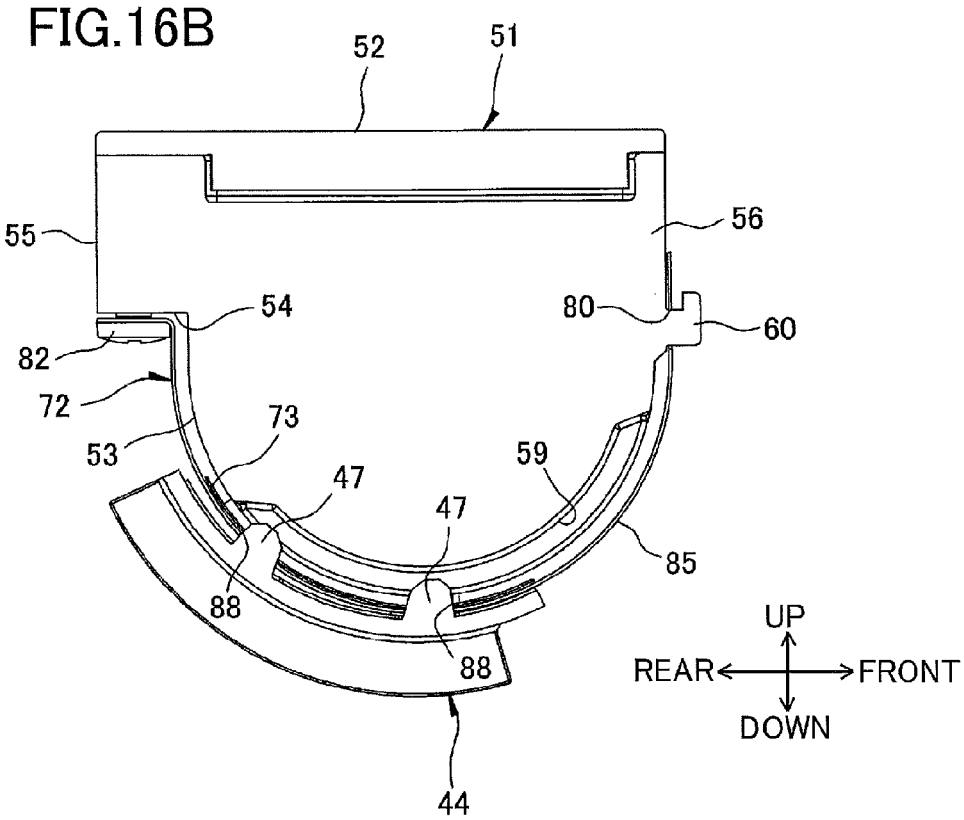
FIG. 16B is a cross-sectional view of the toner box in FIG. 10 and the shutter drive member in FIG. 7 when the shutter is in the closed position.

As shown in FIGS. 15A and 15B, a plurality of positioning protrusions 60 is formed on the front edge of the arcing surface 53. The positioning protrusions 60 are spaced at intervals in the left-to-right direction. As shown in FIGS. 16A and 16B, each positioning protrusion 60 has a hook shape, extending forward, then bending and extending upward.

As shown in FIG. 11, recessions 61 and 62 are respectively formed in the left and right ends of the main body 51 in the lowest portion of the arcing surface 53. The recession 61 on the left side is open in the left side surface 56 of the main body 51, while the recession 62 on the right side is open in the right side surface 57 of the main body 51.

The toner box 11 further includes toner seals 71 affixed to the arcing surface 53 of the main body 51, a shutter cover 72 disposed so as to cover the arcing surface 53, and a shutter 73 disposed between the arcing surface 53 and shutter cover 72.

(2) Toner Seals

As shown in FIG. 11, one of the toner seals 71 is provided for each main-body-side communication through-hole 58. The toner seal 71 has a sheet-like form and is formed with an opening or through-hole 74 at a position corresponding to the main-body-side communication through-hole 58. The area of the opening 74 is greater than the area of the main-body-side communication through-hole 58. Thus, the toner seals 71 are fixed to the arcing surface 53 of the main body 51 so that the openings 74 are aligned and in communication with the corresponding main-body-side communication through-holes 58 and, hence, encircle the main-body-side communication through-holes 58.

Figure 12:
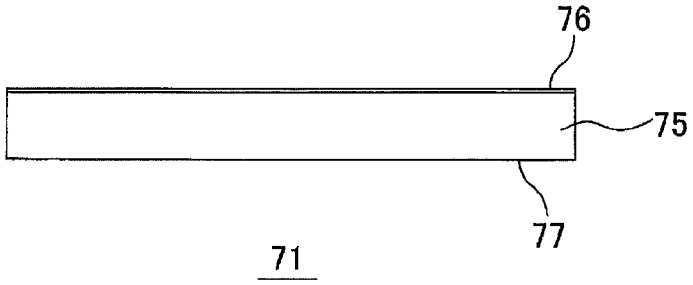
FIG. 12 is a side view of a toner seal shown in FIG. 11.

As shown in FIG. 12, each toner seal 71 has a laminated structure (two-layer structure) configured of an elastic layer 75, and a mesh layer 76 disposed on one surface of the elastic layer 75.

The elastic layer 75 is formed of a resilient foam material, such as the product PORON® (trade name, registered trade mark) manufactured by Rogers Inoac Corporation. The elastic layer 75 is formed much thicker than the mesh layer 76. A fixing surface 77 constituting the surface of the elastic layer 75 opposite the mesh layer 76 is fixed to the arcing surface 53 of the main body 51 with adhesive.

Figure 13:
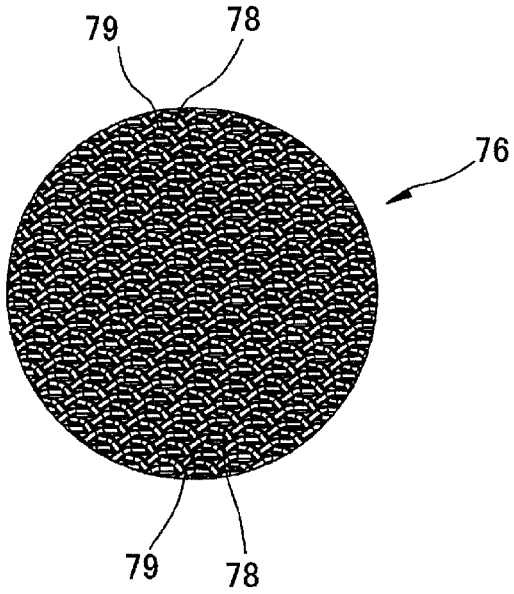
FIG. 13 is a partial perspective view of the surface of a mesh layer shown in FIG. 12.
Figure 14:
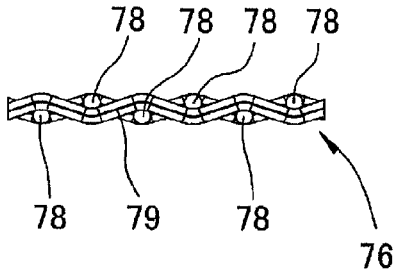
FIG. 14 is a cross-sectional view of the mesh layer.

FIG. 13 shows a surface portion of the mesh layer 76, while FIG. 14 shows a cross-sectional portion of the same. As shown in the drawings, the mesh layer 76 includes warp fibers 78 and weft fibers 79 interlaced in a plain weave (an alternating over and under pattern).

As shown in FIGS. 15A and 15B, the portion of the toner seal 71 disposed forward of the main-body-side communication through-hole 58 (on the front end side of the arcing surface 53) has a width D1 along the circumferential direction of the arcing surface 53. The portion of the toner seal 71 disposed rearward of the main-body-side communication through-hole 58 (on the rear end side of the arcing surface 53) has a width D2 along the circumferential direction of the arcing surface 53. The width D1 is greater than the width D2.

(3) Shutter Cover

The shutter cover 72 is curved to conform to the arcing surface 53 of the main body 51. The shutter cover 72 is formed of a resin film. The shutter cover 72 has a thickness greater than or equal to 0.03 mm and smaller than or equal to 0.3 mm, and preferably greater than or equal to 0.08 mm and smaller than or equal to 0.2 mm. The left-to-right dimension of the shutter cover 72 is approximately equal to the same dimension of the arcing surface 53, so that the shutter cover 72 covers the arcing surface 53 across substantially the entire width in the left-to-right direction.

As shown in FIG. 11, a plurality of positioning openings 80 is formed in the front edge portion of the shutter cover 72 at intervals in the left-to-right direction. As shown in FIGS. 16A and 16B, the positioning protrusions 60 formed on the arcing surface 53 of the main body 51 are engaged in the positioning openings 80. More specifically, the positioning openings 80 are formed in the front edge portion of the shutter cover 72 at positions in the left-to-right direction corresponding to the positioning protrusions 60 and of a sufficient size for inserting the positioning protrusions 60. After the positioning protrusions 60 are inserted into the corresponding positioning openings 80, the top edges of the positioning openings 80 engage the positioning protrusions 60.

The rear edge part of the shutter cover 72 is folded back to conform to the fixing surface 54 of the main body 51. A plurality of screw insertion through-holes 81 are formed in this rear edge portion of the shutter cover 72 at intervals in the left-to-right direction, as shown in FIG. 11. As shown in FIGS. 15A and 15B, the shutter cover 72 is attached to the main body 51 by engaging the positioning protrusions 60 in the respective positioning openings 80, and by inserting screws 82 through all of the screw insertion through-holes 81 and screwing the tips of the screws 82 into the fixing surface 54 of the main body 51.

As shown in FIGS. 10 and 11, cover-side communication through-holes 83 are formed in the shutter cover 72 at positions corresponding to the toner seals 71. Each of the cover-side communication through-holes 83 has a rectangular shape and is elongated in the left-to-right direction. Further, the cover-side communication through-hole 83 has a greater open area than the area of the main-body-side communication through-hole 58 so as to expose the main-body-side communication through-hole 58 in its entirety. The size of each cover-side communication through-hole 83 is such that when the shutter 73 is in an open position (described later), as shown in FIG. 15A, a gap is formed between the rear edge of the corresponding toner seal 71 and the rear edge of the cover-side communication through-hole 83, gaps are formed between the left and right edges of the corresponding toner seal 71 and the left and right edges of the cover-side communication through-hole 83, and the front edge portion of the corresponding toner seal 71 is interposed between the shutter cover 72 and the arcing surface 53 of the main body 51. Consequently, when the shutter 73 is in the open position, the shutter cover 72 does not cover the rear edge and both left and right edges of the toner seal 71, allowing these edges to protrude outward through the cover-side communication through-hole 83.

As shown in FIG. 11, slanted parts 84 having portions angled relative to the circumferential direction of the shutter cover 72 are formed on the shutter cover 72 in both rear side corners of each cover-side communication through-hole 83 as part of the peripheral edge of the cover-side communication through-hole 83. With the slanted parts 84, the left-to-right width of each cover-side communication through-hole 83 grows narrower toward the rear edge of the shutter cover 72.

The part of each slanted part 84 forming a peripheral edge portion of each cover-side communication through-hole 83 may extend in a straight line or follow a gentle curve, provided that the portion is slanted relative to the circumferential direction of the shutter cover 72. These portions of the slanted parts 84 are shaped in a gentle curve in the example of FIG. 11.

Guide slits 85 elongated in the front-to-rear direction (circumferential direction of the shutter cover 72) are formed in the shutter cover 72 at positions corresponding to the relief grooves 59 formed in the main body 51. The guide slits 85 have a front-to-rear length that is greater than or equal to the front-to-rear length of the relief grooves 59. The left-to-right width of the guide slits 85 is also greater than or equal to the left-to-right width of the relief grooves 59. Each guide slit 85 confronts the corresponding relief groove 59 in its entirety.

Locking member insertion through-holes 86 and 87 are also formed in the shutter cover 72 at positions corresponding to the recessions 61 and 62 formed in the main body 51.

(4) Shutter

As shown in FIG. 11, the shutter 73 curves along the arcing surface 53 of the main body 51. The shutter 73 is formed of a resin film having a width in the left-to-right direction slightly smaller than the left-to-right width of the shutter cover 72.

The dimension of the shutter 73 along the circumferential direction of the arcing surface 53 is greater than the same dimension of the toner seals 71 and is set such that the shutter 73 does not contact the fixing surface 54 and the positioning protrusions 60 when moving between an open position and a closed position described later.

Two shutter drive openings 88 separated by a prescribed interval in the circumferential direction of the shutter 73 are formed in the shutter 73 at positions opposing each relief groove 59 in the main body 51. The distance between the two shutter drive openings 88 at each position is set such that all shutter drive openings 88 confront a corresponding relief groove 59 and confront and communicate with a corresponding guide slit 85 formed in the shutter cover 72, regardless of whether the shutter 73 is in the open position or the closed position.

V-shaped notches 89 are formed in the rear edge of the shutter 73 (the edge of the shatter 73 on the rear edge side of the arcing surface 53) at positions in the left-to-right direction corresponding to the main-body-side communication through-holes 58 formed in the main body 51. The V-shaped notches 89 open toward the rear edge side of the arcing surface 53. Forming the V-shaped notches 89 in this way, produces sloped parts 90 in the rear edge of the shutter 73 that are angled relative to the circumferential direction of the shutter 73.

Locking openings 91 and 92 are also formed in the shutter 73 at positions opposing the recessions 61 and 62 formed in the main body 51 when the shutter 73 is in the closed position. Hence, when the shutter 73 is in the closed position, the locking openings 91 and 92 confront the recessions 61 and 62, respectively, and also confront the respective locking member insertion through-holes 86 and 87 formed in the shutter cover 72. Accordingly, the recession 61 and locking member insertion through-hole 86 are in communication via the locking opening 91, and the recession 62 and locking member insertion through-hole 87 are in communication via the locking opening 92.

The shutter 73 is interposed between the arcing surface 53 of the main body 51 and the shutter cover 72. While held between the arcing surface 53 and shutter cover 72, the shutter 73 can move between an open position and a closed position described next.

(5) Open Position of the Shutter

In the open position shown in FIG. 15A, the shutter 73 is positioned on the front side of the cover-side communication through-holes 83 formed in the shutter cover 72. More specifically, when the shutter 73 is in the open position, the rear edge of the shutter 73 is positioned farther forward than the front edges of the cover-side communication through-holes 83, and the rear edge portion of the shutter 73 is interposed between the front edge portion of the toner seal 71 and the shutter cover 72. Therefore, each main-body-side communication through-hole 58 formed in the main body 51 and the opening 74 formed in the corresponding toner seal 71 are made open, while being in communication with each other. This provides communication between the interior and exterior of the main body 51. Further, since the rear edge and both left and right edges of the toner seal 71 are exposed, these edges protrude outward through the cover-side communication through-hole 83.

(6) Closed Position of the Shutter

In the closed position shown in FIG. 15B, the shutter 73 is positioned farther rearward than the open position. When the shutter 73 is in the closed position, the rear edge of the shutter 73 is positioned slightly rearward than the rear edges of the cover-side communication through-holes 83. Accordingly, the shutter 73 opposes nearly the entire area of the cover-side communication through-holes 83, excluding the regions opposite part of the V-shaped notches 89 formed in the shutter 73. The toner seals 71 are entirely interposed between the shutter 73 and the arcing surface 53 of the main body 51. As a result, the shutter 73 covers the main-body-side communication through-holes 58 formed in the main body 51 and the openings 74 formed in the toner seals 71 in their entirety, blocking communication between the interior and exterior of the main body 51.

4. Structure of Main Casing

As shown in FIGS. 4B, 17A, 17B and 17C, a guide 151 is formed at each of left and right inner side surfaces that define an inner space of the main casing 2. More specifically, the main casing 2 defines therein the inner space for accommodating therein the drawer unit 3. The inner space is defined by left and right inner surfaces and upper and lower inner surfaces. The guide 151 protrudes laterally inward from each of the left and right inner side surfaces and extends in frontward/rearward direction at a position immediately below the flange portions 48, 50.

The flange portions 48, 50 of the drawer frame 21 are seated on the guides 151 and are slidably movable on the guides 151, so that the drawer unit 3 is movable between the accommodated position in the main casing 2 and the pull-out position outside of the main casing 2 while being guided and stayed on the guides 151. So, also in the pull-out position, the drawer unit 3 is still partly on the guides 151, and not detached from the main casing 2. In other words, also in the pull-out position, the drawer unit 3 is still mounted in the main casing 2, while partly protruding outside of the main casing 2.

Further, as shown in FIG. 4B, a stop member 117 is provided at and inside the main casing 2 at a position adjacent to the front cover 4. The stop member 117 is of cylindrical shape and protrudes laterally inward (rightward) from the left side surface of the main casing 2. The stop member 117 is positioned above the guide 151 so that the stop member 117 is at the same vertical level or vertical position with the apex end of the interference portion 37 when the interference portion 37 protrudes upward from the flange portion 48. The stop member 117 is positioned at such a vertical position that the flange portion 48 is positioned between the guide 151 and the stop member 117. So, the stop member 117 allows the flange portion 48 to pass between the stop member 117 and the guide 151 but abuts against the apex end of the interference portion 37 protruding upward from the flange portion 48 when the drawer unit 3 is moved from the pull-out position to the accommodated position. As shown in FIG. 4B, the stop member 117 is located in the main casing 2 at the position rearward of the operation member 32 for the rearmost toner box 11 when the drawer unit 3 is at the pull-out position.

Figure 17A:
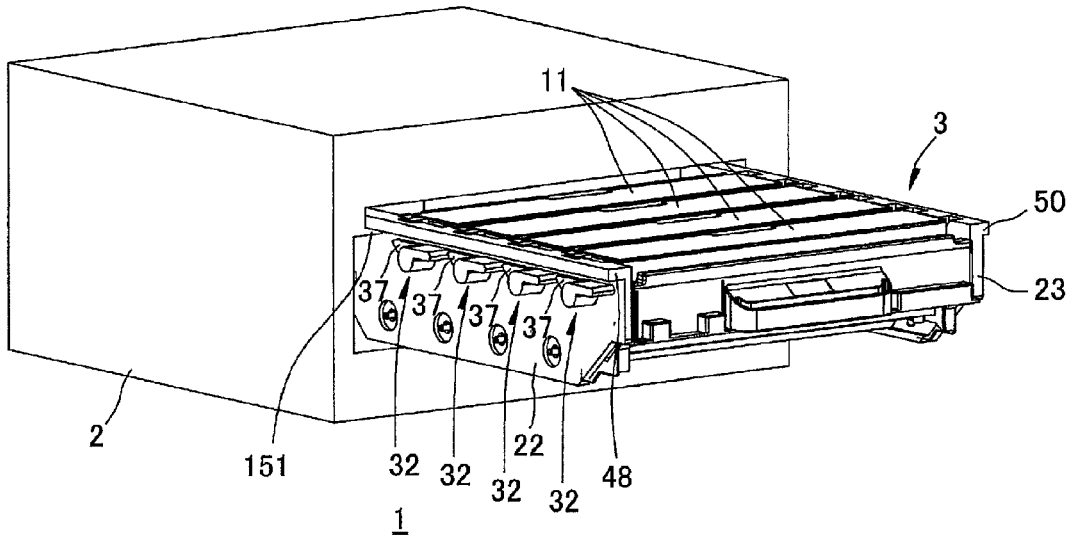
FIG. 17A is a schematic perspective view of the color printer shown in FIG. 1 and showing a state where the drawer unit is at a pull-out position.
Figure 17B:
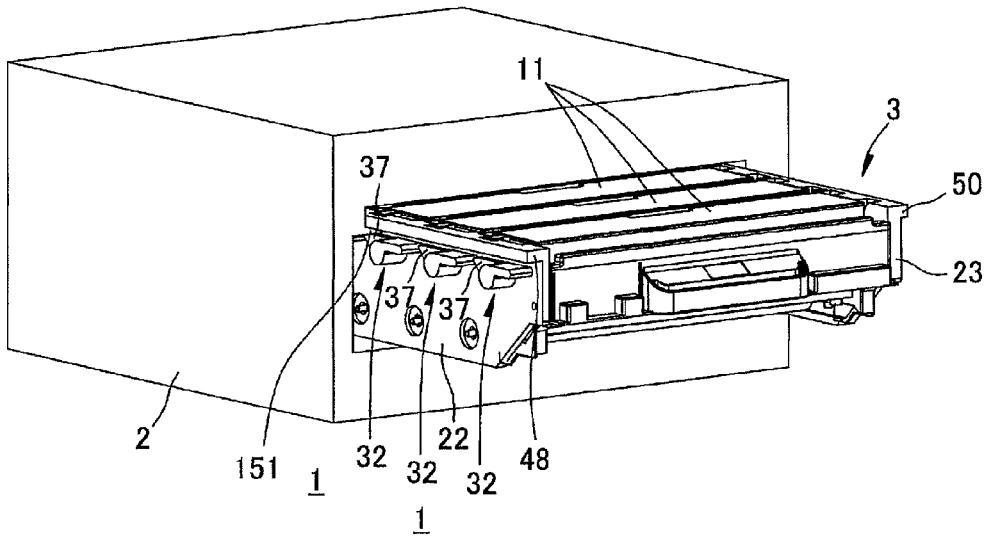
FIG. 17B is a schematic perspective view of the color printer shown in FIG. 1 and showing a state where the drawer unit is on its way to an accommodated position from the pull-out position.
Figure 17C:
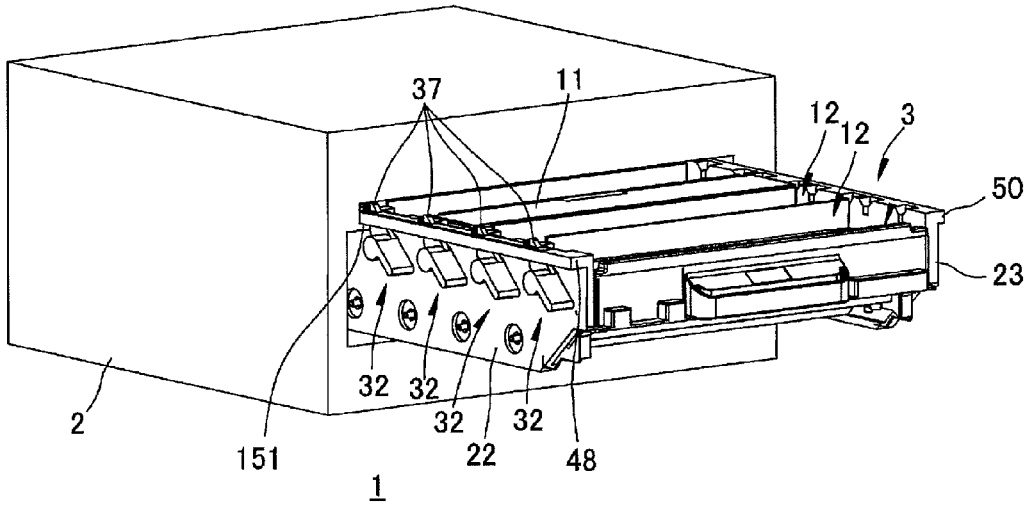
FIG. 17C is a schematic perspective view of the color printer shown in FIG. 1 and showing a state where movement of the drawer unit has just been stopped or prohibited when the drawer unit is on its way to the accommodated position from the pull-out position.

Incidentally, in FIGS. 17A through 17C, the front cover 4 is omitted for simplicity.

5. Mounting the Toner Box

The toner box 11 can be attached to or detached from the developing unit frame 8 at the space 12 above the partitioning wall 42 (FIG. 6) when the drawer unit 3 (drawer frame 21) is at the pull-out position shown in FIG. 17A. In this case, the shutter 73 is at the closed position. When the drawer unit 3 is at the pull-out position, the spaces 12 and the operation members 32 for all the four colors are located outside of the main casing 2. So, the toner boxes 11 for all the four colors can be mounted to and detached from the drawer unit 3, and the operation members 32 for all the four colors can be accessed and manipulated by the user.

When a toner box 11 is not mounted in the corresponding space 12, the operation member 32 is in the first position shown in FIG. 3. The corresponding shutter drive member 44 above the partitioning wall 42 is positioned opposite the rectangular openings 43 formed in the partitioning wall 42, as shown in FIGS. 6 and 7.

At this time, the shutter drive protrusions 47 positioned closer to the front side among the pairs of shutter drive protrusions 47 formed in the shutter drive member 44 protrude upward along a substantially vertical direction, while the shutter drive protrusions 47 positioned closer to the rear protrude in a direction angled upward and forward, as shown in FIG. 16B. When the toner box 11 is mounted in the space 12, each of the shutter drive protrusions 47 engages in a corresponding shutter drive opening 88 through the corresponding guide slit 85.

While the drawer unit 3 remains in the pull-out position, an operator next moves the operation member 32 from the first position to the second position shown in FIG. 2, causing the shutter drive member 44 to move from a position confronting the rectangular openings 43 to a position not confronting the rectangular openings 43 (see FIG. 16A). In association with the movement of the shutter drive member 44, the shutter 73 moves forward from the closed position to the open position.

As shown in FIG. 7, annular frame seals 93 are disposed on top of the partitioning wall 42 at positions corresponding to each of the toner seals 71. That is, the annular frame seals 93 are disposed on a surface of the partitioning wall 42 confronting the corresponding space 12 at positions corresponding to each of the toner seals 71. The annular frame seals 93 surround the periphery or perimeter of each rectangular opening 43. When the shutter 73 is in the open position, the rear edge and both left and right edges of each toner seal 71 protrudes outward through the corresponding cover-side communication through-hole 83. The protruding portions of the toner seal 71 directly press against the corresponding frame seal 93, and portions of the frame seal 93 that do not contact the toner seal 71 contact the shutter cover 72. Therefore, the opening 74 formed in each toner seal 71 is in communication with the corresponding rectangular opening 43 through the opening region in the corresponding frame seal 93, while the toner seal 71 and frame seal 93 seal any gaps formed between the partitioning wall 42 and shutter cover 72.

After all toner boxes 11 have been mounted in the corresponding spaces 12, all operation members 32 have been shifted from their first positions to their second positions, and the shutters 73 of all toner boxes 11 are in their open positions, the toner boxes 11 supply toner to all corresponding developing units 7. Subsequently, the operator pushes the drawer unit 3 to the accommodated position within the main casing 2 and closes the front cover 4 (see FIG. 1). At this time, the user can begin performing image-forming operations with the color printer 1. In this case, as shown in FIG. 17B, all interference portions 37 are positioned below the flange portion 48, so that no mechanical interference occurs between the interference portions 37 and the stop member 117. Thus, the drawer unit 3 can be smoothly moved to the accommodated position while being guided by the guides 151.

On the other hand, the drawer unit 3 cannot be accommodated into the main casing 2 if the all operation members 32 are not moved from the first position to the second position after the toner boxes 11 are mounted in the drawer unit 3. That is, as shown in FIG. 17C, if at least one of the operation members 32 is positioned at the first position so that the apex end portion of the interference portion 37 protrudes above the flange portion 48, the apex end portion is brought into abutment with the stop member 117 provided at the main casing 2 when the drawer unit 3 is moved from the pull-out position to the accommodated position. Thus, further movement of the drawer unit 3 is prohibited.

In order to remove a toner box 11 from the drawer unit 3, the operator opens the front cover 4 and pulls the drawer unit 3 outward from the accommodated position to the pull-out position. Next, the operator shifts the operation member 32 for the desired toner box 11 from the second position shown in FIG. 2 to the first position shown in FIG. 3. This movement of the operation member 32 moves the shutter drive member 44 from a position not confronting the rectangular openings 43 to a position confronting the rectangular openings 43. In association with the movement of the shutter drive member 44, the shutter 73 moves rearward from the open position to the closed position.

Next, the operator removes the toner box 11 from the space 12. Since the shutter 73 is in the closed position at this time, there is no risk of toner spilling out of the main body 51 when the toner box 11 is removed.

5. Locking Mechanism

Since the shutter drive protrusions 47 are not engaged in the shutter drive openings 88 when the toner box 11 has been removed from the drawer unit 3, the shutter 73 can move freely relative to the main body 51 and shutter cover 72. Therefore, if the toner box 11 were jolted, shaken, or the like, the shutter 73 could move out of the closed position.

Figure 18A:
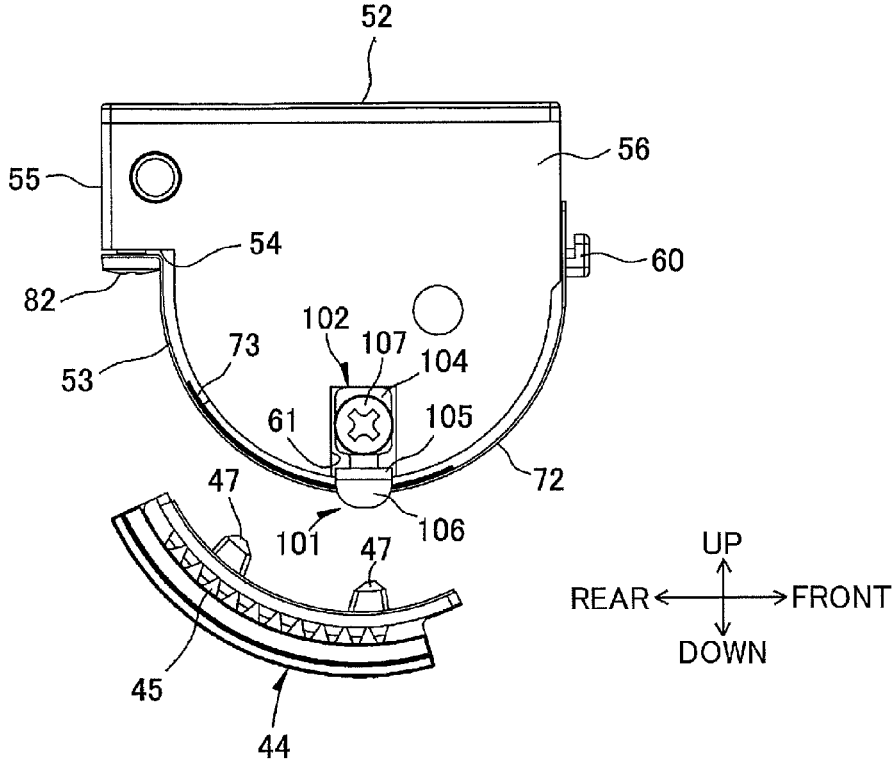
FIG. 18A is a left side view of the toner box in FIG. 10 and the shutter drive member in FIG. 7 showing the state of a locking mechanism before the toner box has been coupled with the shutter drive member.
Figure 18B:
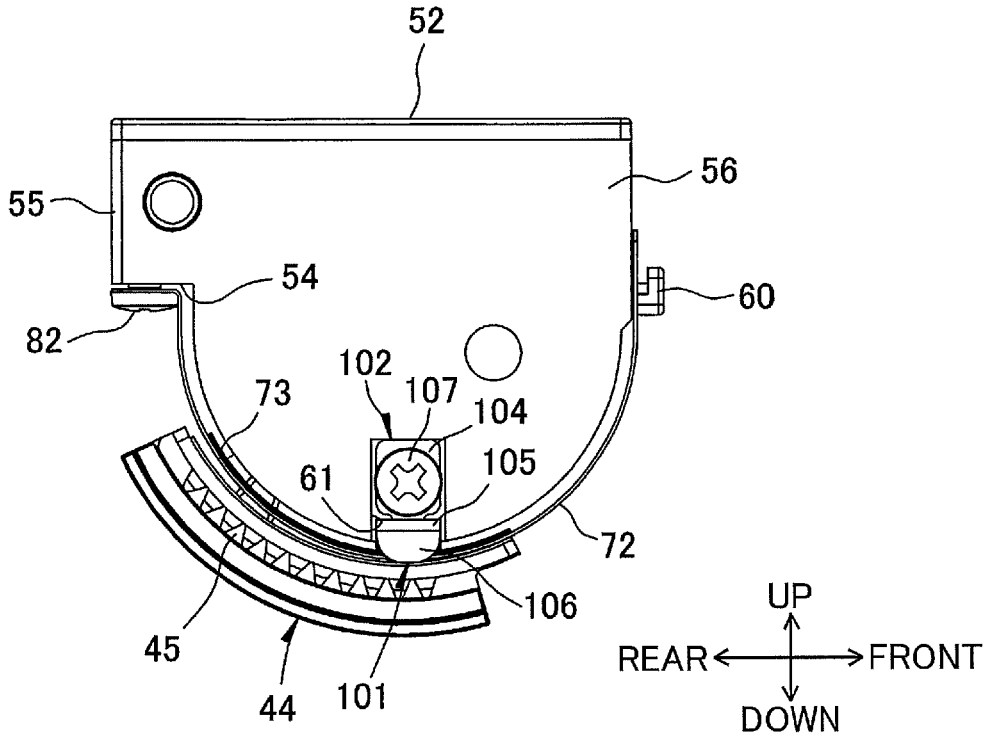
FIG. 18B is a left side view of the toner box in FIG. 10 and the shutter drive member in FIG. 7 showing the state of the locking mechanism after the toner box has been coupled with the shutter drive member.

In order to fix the shutter 73 in the closed position while the toner box 11 is removed from the drawer unit 3, the toner box 11 in the embodiment has a locking mechanism 101 provided in each of the recessions 61 and 62, as shown in FIGS. 18A and 18B. Since the locking mechanism 101 disposed in the recession 61 and the locking mechanism 101 disposed in the recession 62 have the same structure, except in mirror image, the locking mechanism 101 disposed in the recession 61 will be used below for a collective description of the locking mechanisms 101.

Figure 19:
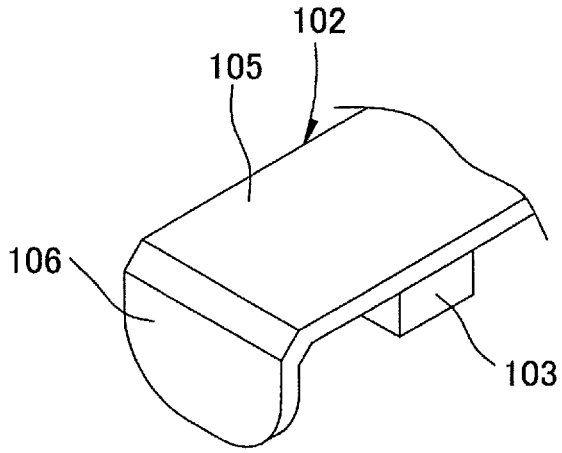
FIG. 19 is a partial perspective view of the locking mechanism shown in FIGS. 18A and 18B.

As shown in FIG. 19, the locking mechanism 101 includes an arm 102, and a locking protrusion 103 attached to the arm 102.

The arm 102 is configured of a flexible thin plate, such as a leaf spring. The arm 102 has the shape of a crank. That is, beginning from one end, the arm 102 extends downward within the recession 61, then bends and extends leftward, and finally bends and extends downward. More specifically, as shown in FIGS. 18A and 18B, the arm 102 is integrally formed of a fixing part 104 extending downward within the recession 61, a holding part 105 extending leftward from the bottom edge of the fixing part 104, and a contact part 106 extending downward from the left edge of the holding part 105. The fixing part 104 is fixed to the leftward-facing surface of the main body 51 inside the recession 61 by a screw 107.

As shown in FIG. 19, the locking protrusion 103 has a flattened square pillar shape and is fixed to the bottom surface of the holding part 105. When the shutter 73 is in the closed position, the locking protrusion 103 on the bottom surface of the holding part 105 is disposed in a position opposing the locking opening 91 formed in the shutter 73.

Figure 20A:
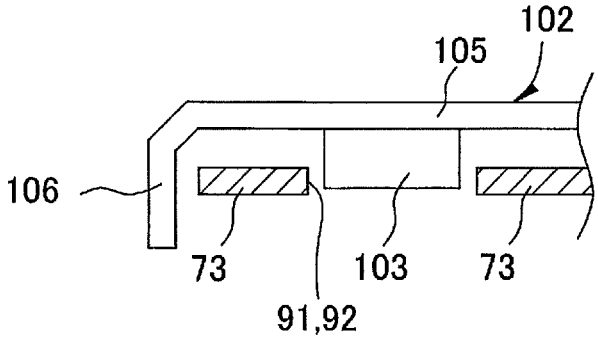
FIG. 20A is a cross-sectional view of the shutter and locking mechanism when the shutter is fixed by the locking mechanism.

Accordingly, when the toner box 11 has been removed from the drawer unit 3, the locking protrusions 103 of both locking mechanisms 101 are respectively inserted into the locking openings 91 and 92 formed in the shutter 73, as shown in FIGS. 18A and 20A, thereby preventing the shutter 73 from moving out of the closed position. Accordingly, the locking mechanisms 101 prevent the shutter 73 from moving out of the closed position while the toner box 11 has been removed from the drawer unit 3.

Figure 20B:
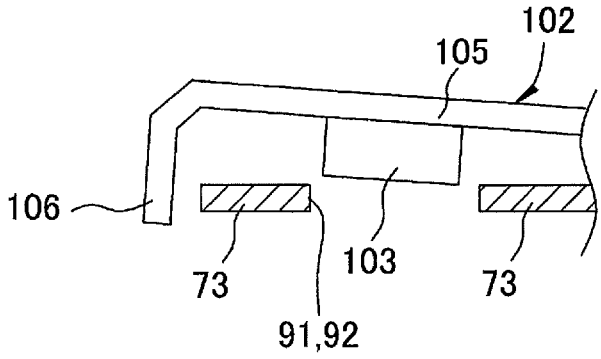
FIG. 20B is a cross-sectional view of the shutter and locking mechanism when the shutter is not fixed by the locking mechanism.

When the toner box 11 is mounted in a corresponding space 12 provided in the drawer unit 3, the bottom edge of the contact part 106 contacts the top surface of the shutter drive member 44 (the top surface of the plate-shaped part 441 or 444) during the mounting operation, as shown in FIGS. 18B and 20B. Thus, as the toner box 11 is moved farther in the mounting direction, the force of resistance received from the shutter drive member 44 causes the holding part 105 of the arm 102 to deform, bending so that the left end of the holding part 105 rises upward. Consequently, the locking protrusions 103 are extracted from the locking openings 91 and 92. At this time, the shutter 73 can move freely relative to the main body 51 and shutter cover 72 and can move together with the shutter drive member 44.

6. Operations (1) According to the above described embodiment, the drawer unit 3 (drawer frame 21) is movable between the accommodated position in the main casing 2 and the pull-out position, in which the drawer unit 3 is partly outside the main casing 2, but is still partly staying on the guides 151 of the main casing 2. The plurality of photosensitive drums 5 are held in the drawer frame 21 and are spacedly arrayed side by side in the frontward/rearward direction which is the moving direction of the drawer unit 3. Further, the plurality of developing units 7 each corresponding to each photosensitive drum 5 are also held in the drawer frame 21. Further, the plurality of toner boxes 11 is held in the drawer frame 21. Each toner box 11 is provided for each developing unit 7 and is detachably attached to the drawer frame 21 positioned at the pull-out position.

The toner box 11 includes the main body or toner container 51 accommodating toner therein, and the toner container 51 is formed with the openings (main-body-side communication through-holes) 58 for supplying toner to the developing unit 7. Further, the toner box 11 is provided with the shutter 73 movable between open position and closed position for opening and closing the openings 58.

The shutter 73 is movable between the open position and the closed position by operating the operation member 32. The operation member 32 is movable between the first position and the second position. The shutter 73 is at the closed position when the operation member 32 is at the first position, and the shutter 73 is at the open position when the operation member 32 is at the second position.

The stop member 117 is provided at and inside the main casing 2. The drawer frame 21 is mechanically interfered with the stop member 117 during movement of the drawer unit 3 from the pull-out position to the accommodated position if the operation member 32 is at the first position, thereby stopping the movement of the drawer unit 3. This prevents the drawer unit 3 from being full accommodation into the main casing 2 while the shutter 73 of the toner box 11 is at the closed position, i.e., while the shutter 73 closes the opening 58.

(2) Each operation member 32 is not provided at the upper portion of each toner box 11, but is provided at the drawer frame 21. With this structure, manipulation to the operation member 32 for moving the shutter 73 can be performed near a center of gravity of the color printer 1 in a state where the drawer unit 3 is at the pull-out position. Consequently, tumbling of the printer 1 during manipulation to the operation member 32 can be avoided.

More specifically, now assume a comparative example where the operation members are provided at positions in the upper portion of the toner box. In such a comparative example, the color printer will possibly be overturned. That is, after the drawer unit is pulled out from the main casing, a center of gravity of the color printer is displaced toward the pull-out side of the drawer unit. In this state, the operation to the operation members will possibly impart a force on the drawer unit, thereby generating rotational moment to the printer. Contrarily, according to the present embodiment, the operation members are provided to the drawer unit. So, the operation members can be manipulated at positions closer to the center of gravity of the color printer 1, compared to the case where the operation members are provided in the upper portions of the toner boxes.

Further, dropout of the toner box 11 from the drawer frame 21 can be avoided when the operation member 32 is mechanically interfered with the stop member 117. That is, the toner box 11 may receive pressing force from the stop member 117 so that the toner box 11 may be accidentally detached from the drawer frame 21, if the operation member 32 were provided at the toner box 11 and the operation member 32 were mechanically interfered with the stop member 117. In the present embodiment, in contrast, such accidental dropout of the toner box 11 does not occur because the operation member 32 is provided at the drawer frame 21.

(3) Further, the operation member 32 integrally includes the fulcrum portion 35, the extension portion 36 extending from the fulcrum portion 35 in a direction from the accommodated position to the pull-out position, and the interference portion 37 positioned opposite to the extension portion 36 with respect to the fulcrum portion 35. The interference portion 37 protrudes above the flange portion 48 provided at the upper portion of the side plate 22 when the operation member 32 is at the first position. With this structure, mechanical interference can occur between the interference portion 37 which belongs to the drawer frame 21 and the stop member 117 which belongs to the main casing 2 when the drawer unit 3 is moved from the pull-out position to the accommodated position while the operation member 32 is at the first position.

Further, the stop member 117 is configured to nip the flange portion 48 in cooperation with the guide 151 when the interference portion 37 is mechanically interfered with the stop member 117. With this arrangement, drop out of the drawer frame 21 from the guide 151 due to impacting force caused by the mechanical interference can be avoided.

(4) The plurality of operation members 32 are provided in association with the plurality of toner boxes 11. The stop member 117 is provided at the main casing 2 at the position rearward of the operation member 32 for the rearmost toner box 11 when the drawer unit 3 is at the pull-out position. Accordingly, rearward movement (movement toward the accommodated position) of the drawer unit 3 can be stopped if any one of the operation members 32 is positioned at the first position.

(5) The shutter drive member 44 is provided so as to be connectable with the shutter 73 to move the shutter 73 between the open position and the closed position. The shutter drive member 44 is connected to the operation member 32. Thus, the shutter driving member 44 can be moved upon operation of the operation member 32, to thereby move the shutter 73 between the open position and closed position.

7. Modification (1) First Modification

Figure 21:
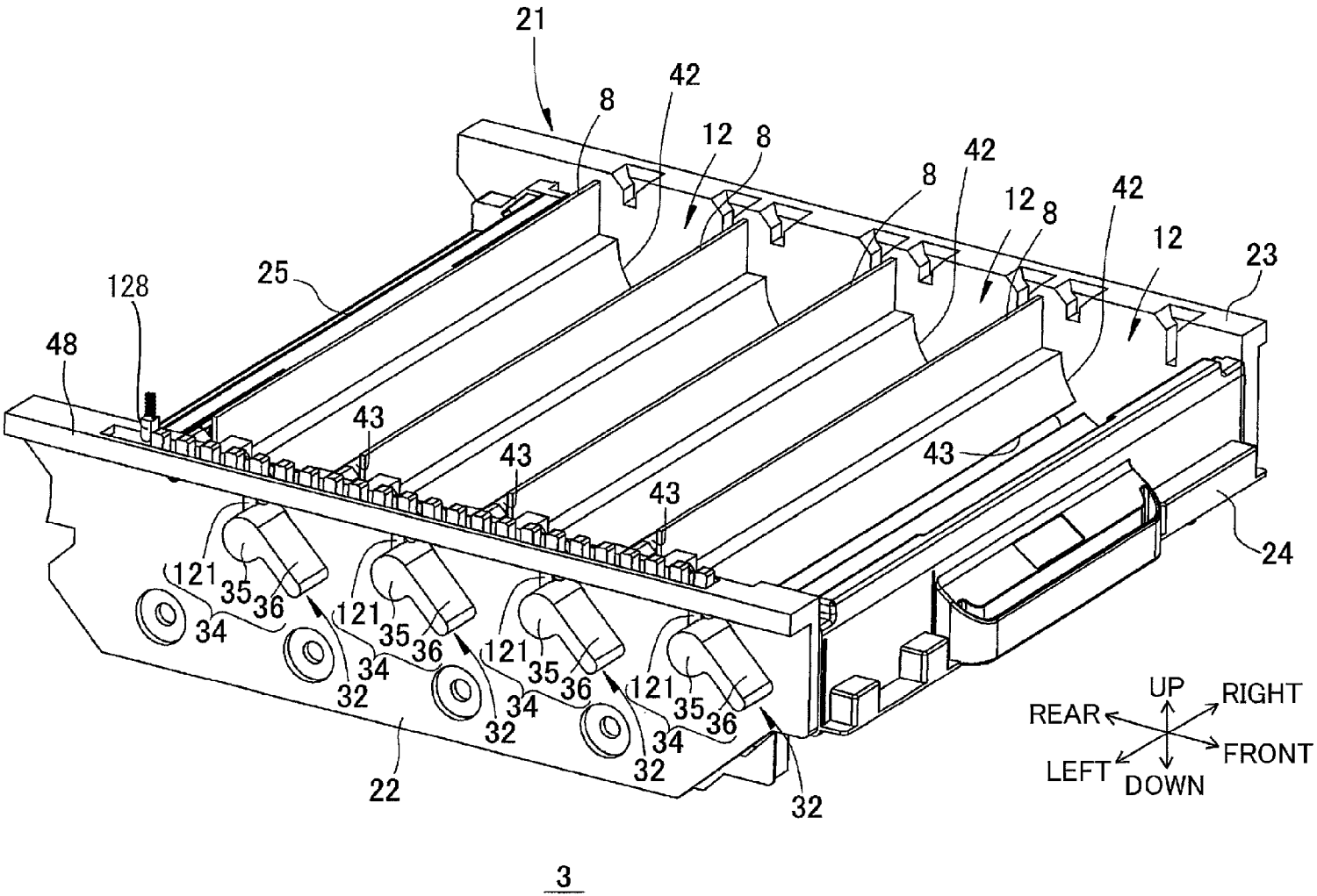
FIG. 21 is a perspective view of a drawer unit and a stop member provided at a main casing according to a first modification.

FIGS. 21 through 24B show a drawer unit and a stop member provided at the main casing 2 according to the first modification. It is noted that in the above-described embodiment, three rectangular openings 43 are formed through the partitioning wall 42. However, in this modification, as shown in FIG. 21, a single slit-shaped opening 43 is formed through the partitioning wall 42, instead of the three rectangular openings 42.

Figure 22A:
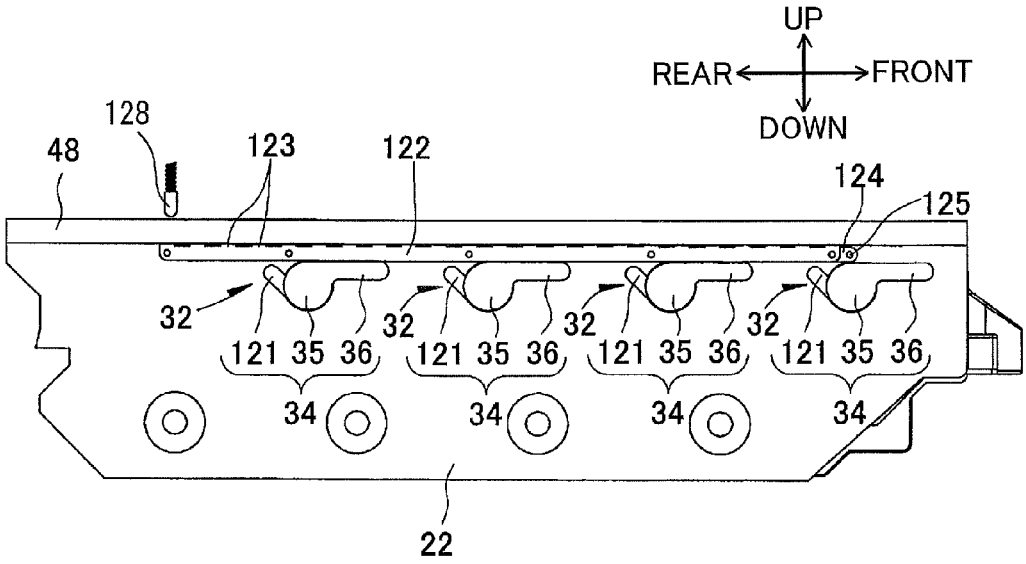
FIG. 22A is a left side view of the drawer unit shown in FIG. 21 and showing a state where an interference member provided at the drawer unit is at a retracted position.
Figure 22B:
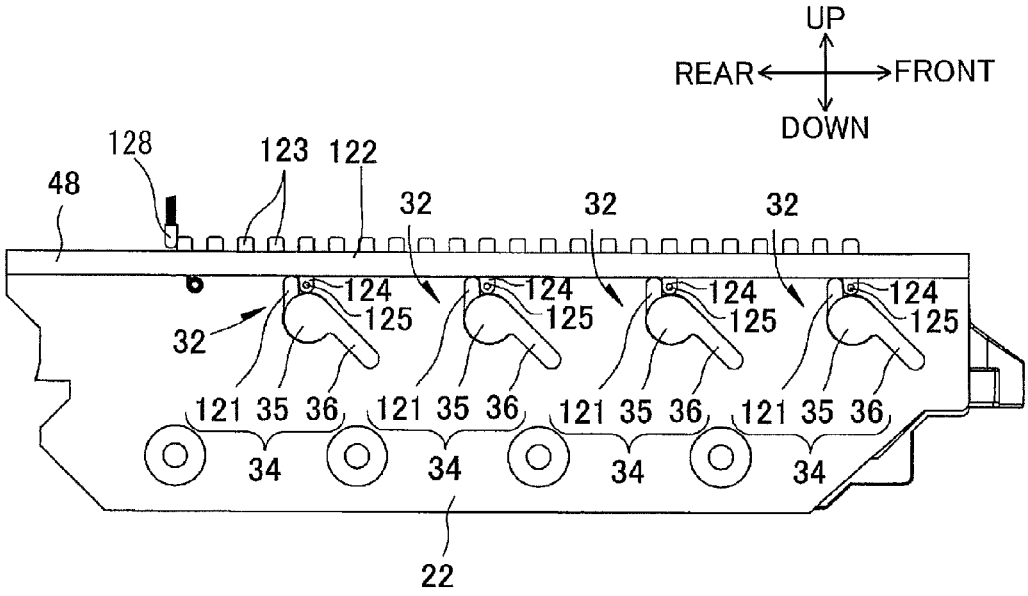
FIG. 22B is a left side view of the drawer unit shown in FIG. 21 and showing a state where the interference member is at an advancing position.

In the drawer unit 3 shown in FIG. 21, the operation member 32 is not provided with the interference portion 37, but is provided with an abutment portion 121. As shown in FIG. 22A, the abutment portion 121 extends rearward and diagonally upward from the fulcrum portion 35 when the operation member 32 is at the second position.

In the drawer unit 3, an interference member 122 is movably provided at a left side (outer side) of the left side plate 22. The interference member 122 is in a form of a square timber and extends in the frontward/rearward direction. The interference member 122 has an upper side provided with a plurality of protrusions 123 protruding upward and having size and configuration identical to one another and arrayed in the frontward/rearward direction with a predetermined interval between neighboring protrusions. The interference member 122 is positioned above the all operation members 32. The flange portion 48 is formed with an elongated slot, so that the interference member 122 can be moved in the slot. The interference member 122 has a lower side confronting the all operation members 32 at a position below the lower surface of the flange portion 48.

The interference member 122 is movably supported to the left side plate 22 through four link members 124. Each link member 124 extends along the left side of the left side plate 22. Each link member 124 has one end portion rotatably supported to the interference member 122, and another end portion provided with a pivot shaft 125 extending rightward. The pivot shaft 125 is rotatably supported to the left side plate 22. With this structure, the interference member 122 can be moved to an advancing position shown in FIG. 23A where the link members 124 are oriented vertically for elevating the interference member 122 and to a retracted position shown in FIG. 23B where the link members 124 are oriented horizontally for descending the interference member 122.

An urged shaft 126 protrudes rightward from a rear end portion of the interference member 122. Further, a coil spring as an urging member 127 is provided at the left side of the left side plate 22 at a position immediately ahead of the urged shaft 126. The urging member 127 has one end portion in abutment with a front side of the urged shaft 126, so that the interference member 122 is urged rearward by the urging force of the urging member 127.

On the other hand, a stop member 128 is provided in the main casing 2 at a position adjacent to the front cover 4. The stop member 128 has a quadrangular prism shape insertable into a space defined between neighboring protrusions 123. A lower end portion of the stop member 128 has an arcuate or semicircular shape curved in the frontward/rearward direction in which a center portion in the frontward/rearward direction is positioned at the most lowest position. A tip end of a spring 129 is connected to an upper end of the stop member 128 for urging the stop member 128 downward. The stop member 128 is positioned in the main casing 2 at such a vertical level or vertical position that as long as no external force is exerted on the stop member 128, the center portion in the vertical direction of the stop member 128 will be at the same vertical level or vertical position with the tip end surface of the protrusion 123 when the interference member 122 is at the advancing position. So, as long as no external force is exerted on the stop member 128, the stop member 128 will abut against some protrusion 123 when the drawer unit 3, whose interference member 122 is at the advancing position, is moved from the pull-out position to the accommodated position.

Figure 23A:
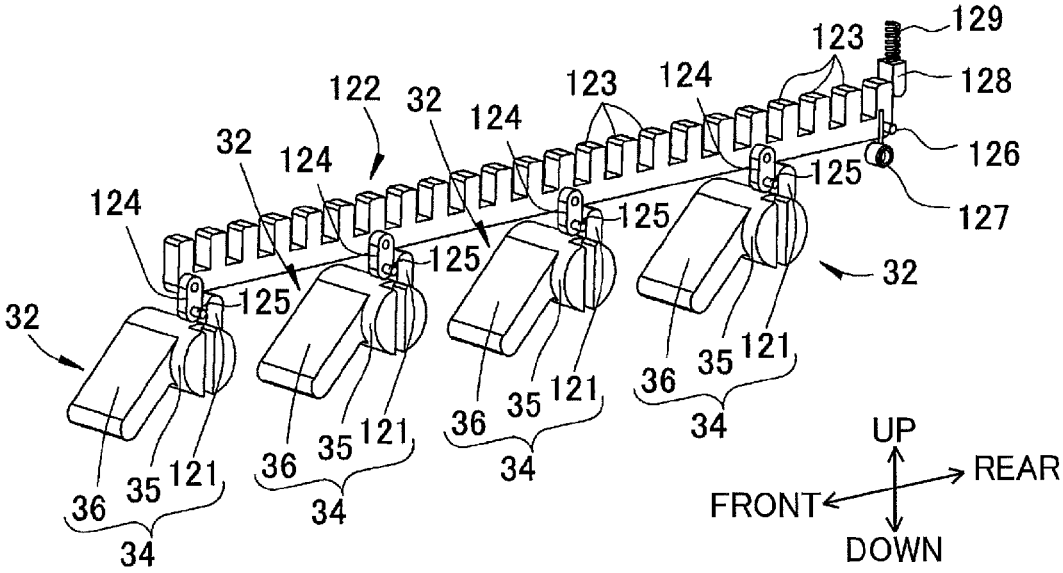
FIG. 23A is a perspective view of a mechanism for elevating the interference member and showing a state where all operation members are at a first position according to the first modification.
Figure 23B:
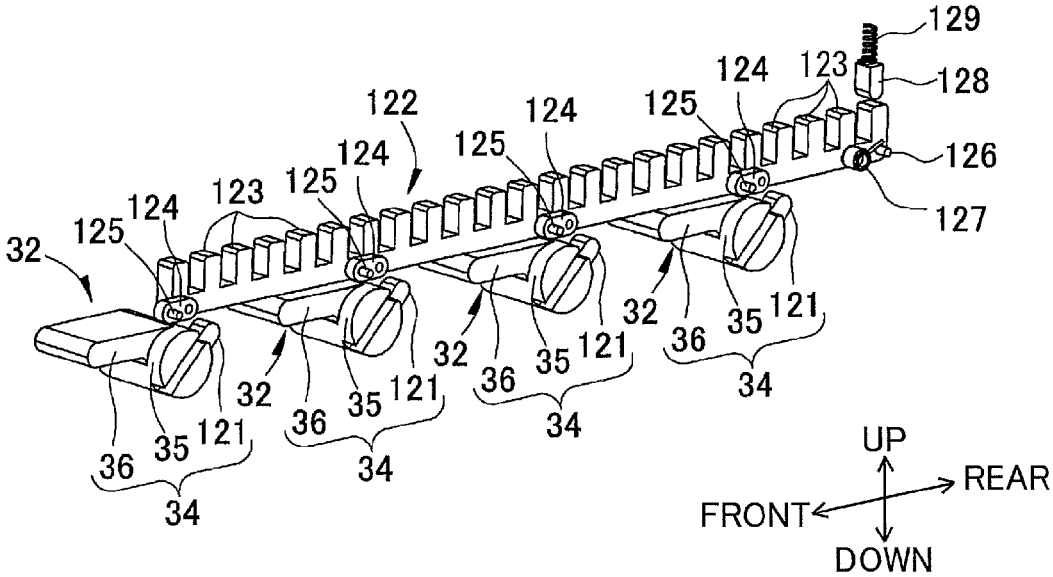
FIG. 23B is a perspective view of the mechanism for elevating the interference member and showing a state where all operation members are at a second position according to the first modification.

As shown in FIG. 23B, when all operation members 32 are at the second position, no abutment portion 121 is in abutment with the link members 124. In other words, no operation member 32 acts on the interference member 122. So, the interference member 122 is positioned at its retracted position because of the biasing force of the urging member 127.

Figure 23C:
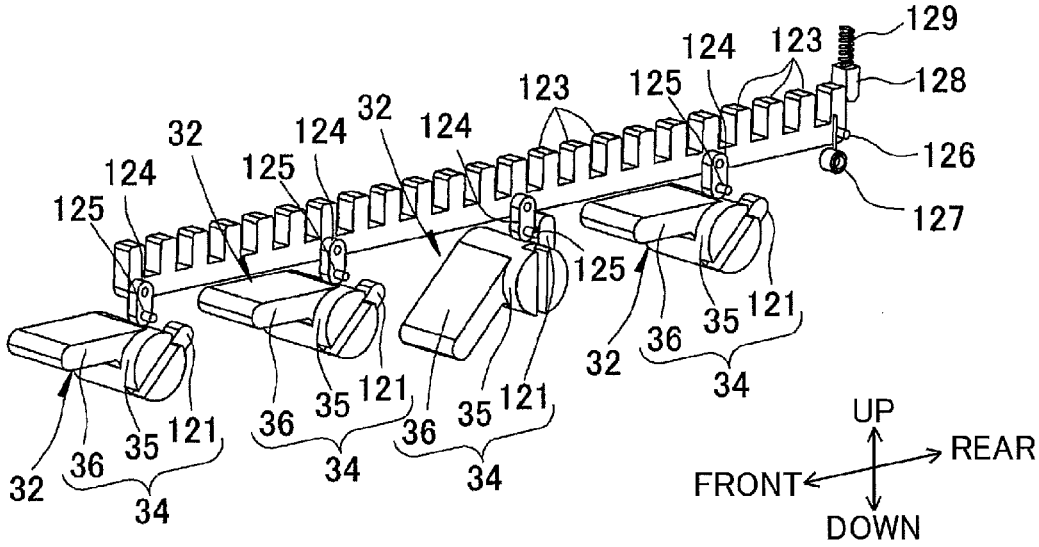
FIG. 23C is a perspective view of the mechanism for elevating the interference member and showing a state where one of the operation members is at the first position whereas remaining three operation members are at the second position according to the first modification.

When at least one of the operation members 32 is moved from the second position to the first position, as shown in FIGS. 23A and 23C, the abutment portion 121 is brought into abutment with the link member 124, so that the link member 124 is pivotally moved in counterclockwise direction in FIG. 23B about an axis of the pivot shaft 125 against the biasing force of the urging member 127. so that the interference member 122 is elevated. Thus, as shown in FIGS. 23A and 23C, the interference member 122 is moved from the retracted position to the advancing position.

As shown in FIGS. 23A and 23C, mechanical interference occurs between the protrusion 123 of the interference member 122 and the stop member 128 at the main casing 2 during movement of the drawer unit 3 from the pull out position to the accommodated position if at least one of the operation members 32 is positioned at the first position. Thus, further movement of the drawer unit 3 toward the accommodated position is prevented.

As shown in FIG. 23B, the interference member 122 is at the retracted position when all operation members 32 are at the second position. Therefore, the interference member 122 can be moved past the lower end surface of the stop member 128 when the drawer unit 3 is moved from the pull-out position to the accommodated position. Accordingly the stop member 128 does not obstruct the movement of the drawer unit 3.

Consequently, according to the first modification also, accommodation of the drawer unit 3 into the main casing 2 can be prevented while the shutter 73 of the toner box 11 is positioned at the closed position.

Figure 24A:
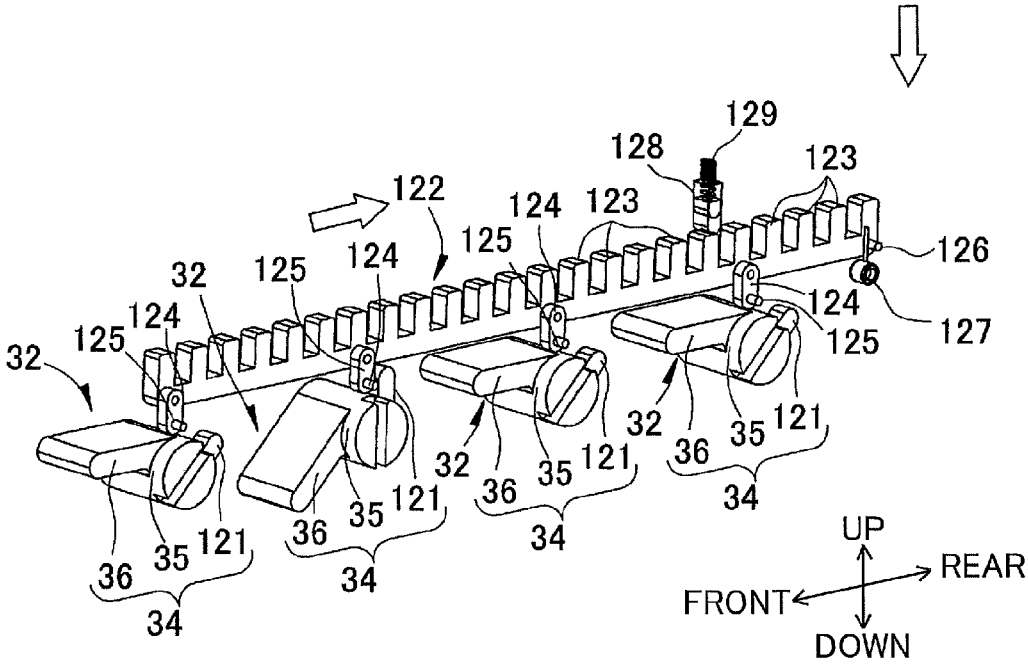
FIG. 24A is a perspective view showing a state where the stop member is in abutment with one of protrusions provided at the interference member according to the first modification.
Figure 24B:
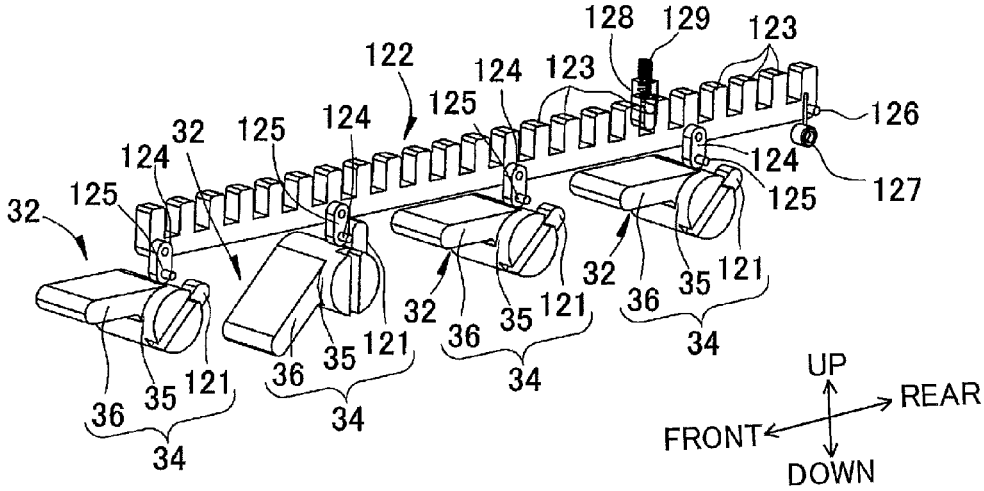
FIG. 24B is a perspective view showing a state where the stop member enters into a space between neighboring protrusions provided at the interference member according to the first modification.

It is noted that after the user pulls the drawer unit 3 from the accommodated position, the user will possibly shift some operation member 32 from the second position to the first position to close the corresponding shutter 73 as shown in FIG. 24A, even though the drawer unit 3 has not yet reached the pull-out position and the spaces 12 for all the toner boxes 11 have not yet completely been outside the main casing 2. In such a case, the interference member 122 moves from the retracted position to the advancing position, upon which the stop member 128 is pushed upward by some protrusion 123 in the interference member 122. After manipulating the operation member 32 from the second position to the first position as described above, the user will possibly move the drawer unit 3 back to the accommodated position, without manipulating the operation member 32 from the first position back to the second position. In such a case, the stop member 128 will be rapidly inserted into the space between neighboring protrusions 123 as shown in FIG. 24B due to the force of the spring 129. This is because the plurality of protrusions 123 are provided at the interference member 122. Thus, accommodation of the drawer unit 3 into the main casing 2 is prohibited by the stop member 128 while the shutter 73 of some toner box 11 is at the closed position.

Further, according to the first modification, mechanical interference between the stop member 128 at the main casing 2 and the interference member 122 at the drawer unit 3 can occur only by a slight movement of the drawer unit 3 (by the movement by the thickness of the protrusion 123 in the frontward/rearward direction), impacting force due to the mechanical interference can be reduced as low as possible.

Further, the pull-out stroke of the drawer unit 3 can be fixed by the insertion of the stop member 128 into the space between the neighboring protrusions 123 when the specific toner box 11 is detached from the drawer unit 3. The operator can easily recognize an attachment location of the new toner box 11.

(2) Second Modification

The drawer unit 3 shown in FIG. 2 has four operation members 32, whereas in the second modification, a single operation member 32 is provided at a front end portion of the left side plate 22.

Figure 25A:
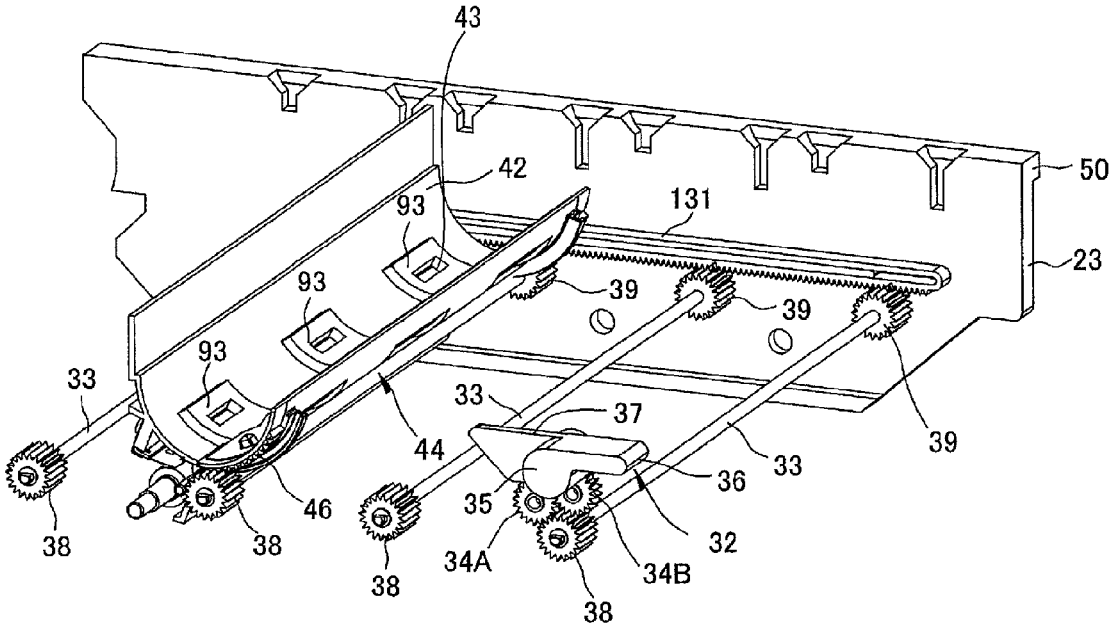
FIG. 25A is a perspective view of a mechanism including a single operation member and showing a state where the operation member is at a second position according to a second modification.
Figure 25B:
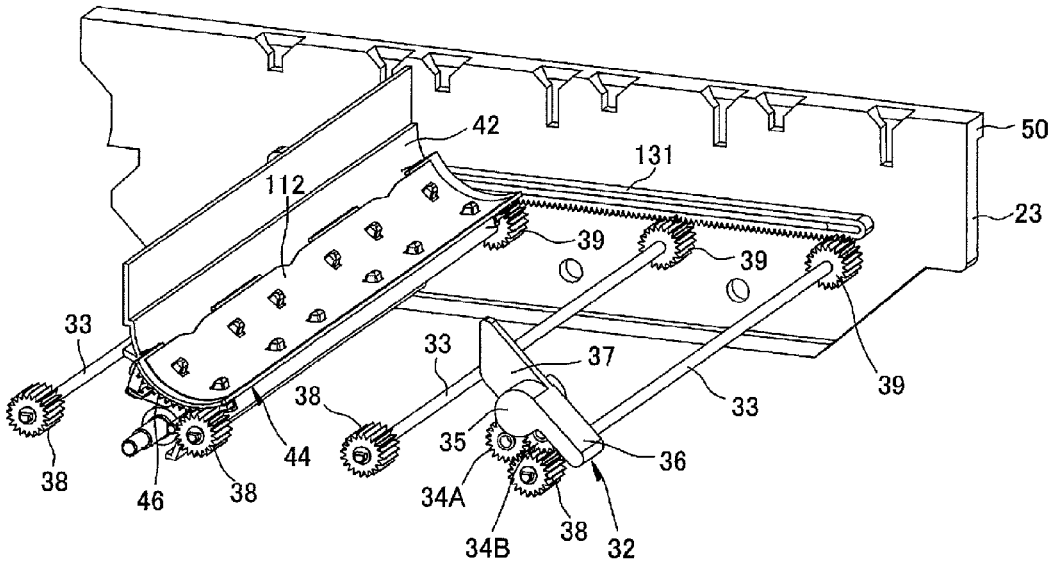
FIG. 25B is a perspective view of the mechanism including the single operation member and showing a state where the operation member is at a first position according to the second modification.

In the second embodiment, an interlocking mechanism shown in FIGS. 25A and 25B is provided for interlockingly move four shutter drive members 44 by operating the single operation member 32.

According to the interlocking mechanism, only one operation member 32 is provided at a frontmost space 12 (FIG. 2), and remaining three operation members are dispensed with. A shaft 33, a left pinion gear 38 and a right pinion gear 39 are provided for each space 12. A gear wheel (not shown) is provided coaxially and integrally with the fulcrum portion 35 of the single operation member 32, and the gear wheel is drivingly connected to the left pinion gear 38 through intermediate gears 34A, 34B.

A rack gear 131 extends in the frontward/rearward direction at a position above the four right pinion gears 39. The rack 131 has a lower teeth meshedly engaged with the right pinion gears 39.

The left pinion gear 38 positioned below the operation member 32 is rotated about its axis when the single operation member 32 is moved from its first position shown in FIG. 25B to the second position shown in FIG. 25A. The rotation of the left pinion gear 38 rotates the frontmost shaft 33 and the frontmost right pinion gear 39, which in turn linearly moves the rack gear 131 frontward. As a result, remaining three right pinion gears 39 and the shafts 33 are rotated. Thus, the four shutter drive members 44 positioned in confrontation with the openings 43 are interlockingly moved frontward to the positions out of alignment with the openings 43. If the single operation member 32 is moved from the second position to the first position, the four shutter drive members 44 are moved rearward to the positions in confrontation with the openings 43.

With this structure, operation to the single operation member 32 causes interlocking movement of the all shutters 73 (FIGS. 16A, 16B) to the open positions or to the closed positions, thereby improving operability.

Further, since the single operation member 32 is positioned at the front end portion of the drawer frame 21, enhanced operability can result.

While the invention has been described in detail with reference to the embodiment and modifications thereof, it would be apparent to those skilled in the art that various changes and modifications may be made therein without departing from the spirit of the invention.

What is claimed is:

1. An image forming device comprising:

a main casing defining an accommodation space;

a drawer configured to move in a moving direction between an accommodated position in which the drawer is accommodated in the accommodation space and a pull-out position in which at least part of the drawer is outside the accommodation space;

a plurality of cartridges detachably attachable to the drawer;

a moving member configured to move between a first position and a second position, the moving member being provided at the drawer; and a stop member provided in the main casing, the stop member configured to:

prevent the drawer from moving to the accommodated position when the drawer is on its way to the accommodated position from the pull-out position while the moving member is at the first position, and permit the drawer to move to the accommodated position when the drawer is on its way to the accommodated position from the pull-out position while the moving member is at the second position.

2. The image forming device as claimed in claim 1, wherein the moving member comprises:

a fulcrum portion rotatable about an axis;

an extension portion extending from the fulcrum portion in a direction from the accommodated position to the pull-out position; and an abutment portion extending from the fulcrum portion and positioned opposite to the extension portion with respect to the fulcrum portion, the abutment portion of the moving member at the first position being abuttable on the stop member when the drawer is moved toward the accommodated position from the pull-out position to prevent the drawer from further moving.

3. The image forming device as claimed in claim 2, wherein the drawer has an upper surface; and wherein the abutment portion protrudes upward from the upper surface when the moving member is at the first position.

4. The image forming device as claimed in claim 2, wherein the moving member is provided for each cartridge resulting in a plurality of the moving members; and wherein the stop member is positioned downstream of a moving member associated with a most downstream cartridge in a moving direction from the pull-out position to the accommodated position when the drawer is at the pull-out position such that the stop member can be mechanically interfered with any one of the abutment portions when any one of the moving members is at the first position.

5. The image forming device as claimed in claim 1, wherein the moving member is a single moving member for the plurality of the cartridges.

6. The image forming device as claimed in claim 5, wherein the single moving member is provided at the drawer at a position adjacent to a most downstream cartridge in a direction from the accommodated position to the pull-out position.

7. The image forming device as claimed in claim 1, further comprising an interference member provided at the drawer and movable between an advancing position to be mechanically interfered with the stop member and a retracted position away from the stop member, wherein the moving member comprises:

a fulcrum portion rotatable about an axis;

an extension portion extending from the fulcrum portion in a direction from the accommodated position to the pull-out position; and an abutment portion extending from the fulcrum portion and positioned opposite to the extension portion with respect to the fulcrum portion, the abutment portion being abuttable on the interference member to move the interference member to the advancing position while the moving member is at the first position.

8. The image forming device as claimed in claim 7, wherein the interference member has an upper portion provided with a plurality of protrusions protruding upward and arrayed in the moving direction.

9. The image forming device as claimed in claim 8, further comprising an urging member configured to urge the interference member toward the retracted position.

10. The image forming device as claimed in claim 8, wherein the stop member is movable upward and downward to selectively ride on one of the protrusions or be entered into a space defined between neighboring protrusions.

* * * * *